US008439134B2

(12) United States Patent
Vezirian

(10) Patent No.: US 8,439,134 B2
(45) Date of Patent: May 14, 2013

(54) METHOD AND APPARATUS FOR A TRUE GEOMETRY, DURABLE ROTATING DRILL BIT

(76) Inventor: Edward Vezirian, Redlands, CA (US)

( * ) Notice: Subject to any disclaimer, the term of this patent is extended or adjusted under 35 U.S.C. 154(b) by 0 days.

(21) Appl. No.: 13/485,525

(22) Filed: May 31, 2012

(65) Prior Publication Data

US 2012/0298424 A1 Nov. 29, 2012

Related U.S. Application Data

(63) Continuation of application No. 12/623,145, filed on Nov. 20, 2009, now Pat. No. 8,201,646.

(51) Int. Cl.
*E21B 10/22* (2006.01)
*E21B 10/18* (2006.01)

(52) U.S. Cl.
USPC ..... 175/371; 175/340; 175/372; 175/393; 384/95; 384/96

(58) Field of Classification Search ..... 175/340, 175/393, 371–372; 384/92–96
See application file for complete search history.

(56) References Cited

U.S. PATENT DOCUMENTS 1,983,316 A 12/1934 Scott
3,964,605 A 6/1976 Vezirian
4,145,094 A 3/1979 Vezirian
4,168,923 A 9/1979 Vezirian
4,176,724 A 12/1979 Vezirian
4,221,270 A 9/1980 Vezirian
4,266,622 A 5/1981 Vezirian
4,325,439 A 4/1982 Vezirian
4,350,060 A 9/1982 Vezirian
4,444,518 A 4/1984 Schramm
4,486,104 A 12/1984 Vezirian
4,499,642 A 2/1985 Vezirian
4,506,997 A 3/1985 Schramm
4,572,306 A * 2/1986 Dorosz ..... 175/371
4,596,472 A 6/1986 Vezirian
4,620,803 A 11/1986 Vezirian
4,623,027 A 11/1986 Vezirian
4,643,792 A 2/1987 Vezirian
4,684,015 A 8/1987 Vezirian
4,703,849 A 11/1987 Vezirian
4,711,311 A * 12/1987 Underwood et al. ..... 175/340
4,744,270 A 5/1988 Vezirian
4,753,706 A 6/1988 Vezirian
4,759,415 A * 7/1988 Pessier ..... 175/340
4,776,599 A 10/1988 Vezirian
4,819,517 A 4/1989 Vezirian
4,854,368 A 8/1989 Vezirian (Continued)

*Primary Examiner* — Giovanna Wright
(74) *Attorney, Agent, or Firm* — Daniel L. Dawes

(57) ABSTRACT

A rotating cone drill bit includes a plurality of mud nozzles extending from the bit body, which are thermally fitted by controlling the temperature differential depending on the corresponding materials, the amount of fit desired, and the diameters of the elements to be fitted and which provide substantially obstruction-free mud paths toward the wellbore bottom. The bit has a plurality of reduced diameter cutter assemblies, each having a journal projecting from a corresponding leg. The journal has at least two cylindrical bearing surfaces and an annular groove formed therebetween and a spindle. An annular retention segment is rotatably mounted in the groove. The retention segment has an outer radial surface engaging a portion of one of the bearing surfaces of the cone, and an energy beam welding area fusing substantially the entire engaging surfaces of the retention segment and the cone.

4 Claims, 25 Drawing Sheets

U.S. PATENT DOCUMENTS 4,875,532 A * 10/1989 Langford, Jr. ..... 175/371
D304,514 S 11/1989 Vezirian
5,024,539 A 6/1991 Vezirian
5,040,623 A 8/1991 Vezirian

* cited by examiner

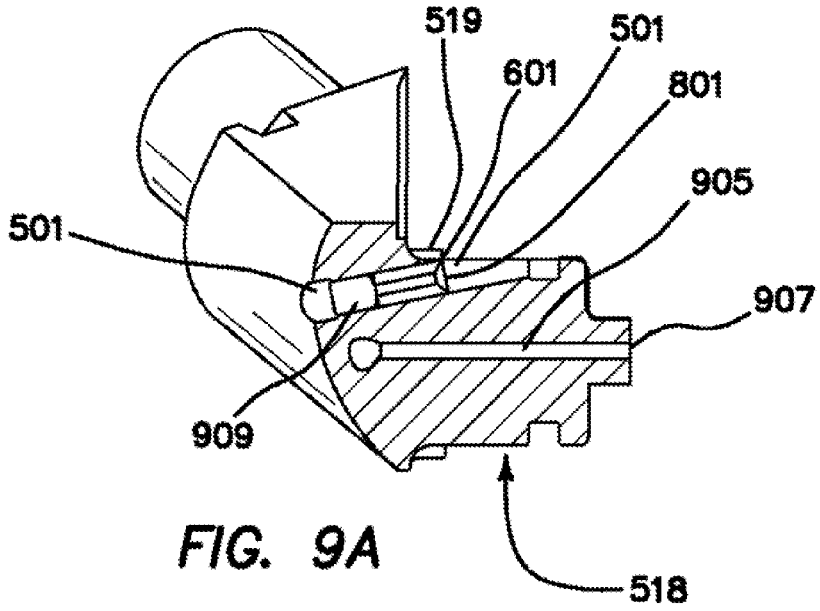
FIG. 9A
FIG. 9B
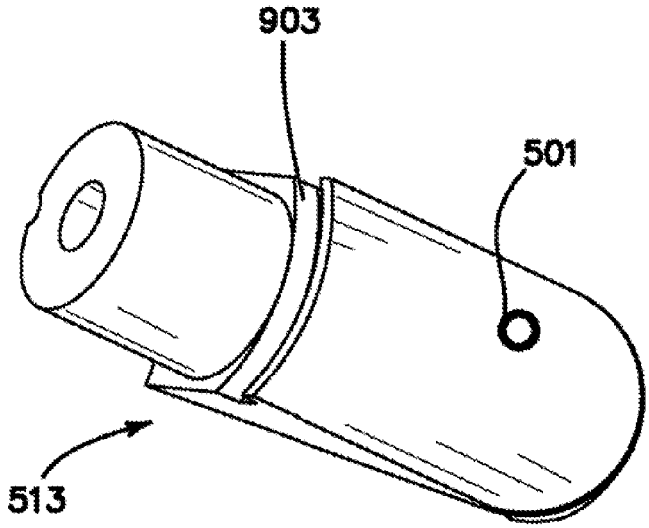
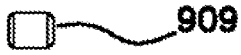
FIG. 9C
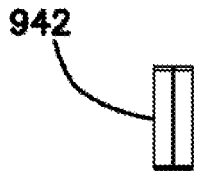
FIG. 9D

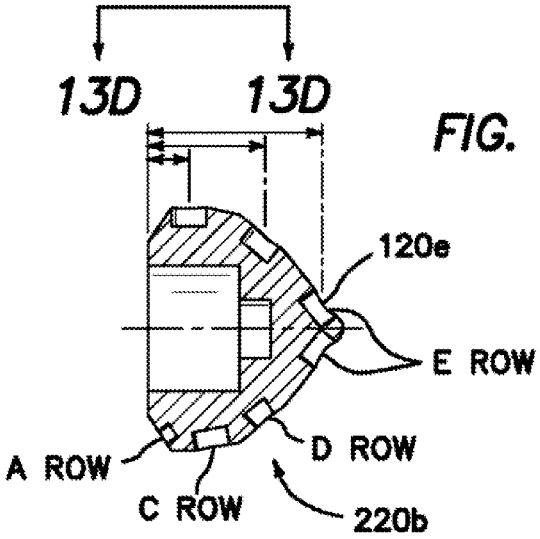
FIG. 13A
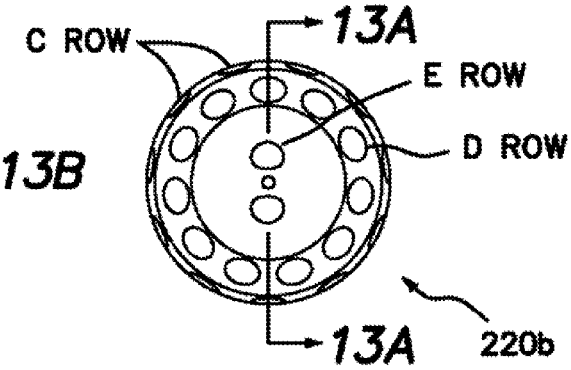
FIG. 13B
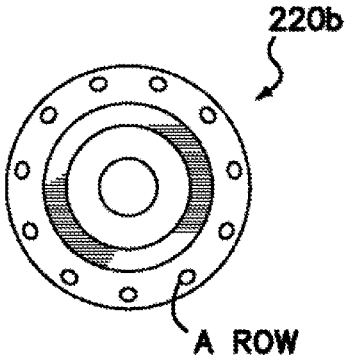
FIG. 13C
FIG. 13D
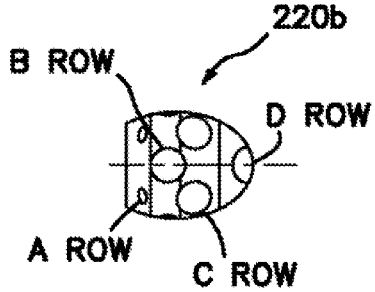

METHOD AND APPARATUS FOR A TRUE GEOMETRY, DURABLE ROTATING DRILL BIT

RELATED APPLICATIONS

The present application is a continuation of application of U.S. patent application Ser. No. 12/623,145, filed on Nov. 20, 2009, issued as U.S. Pat. No. 8,201,646 incorporated herein by reference.

BACKGROUND OF THE INVENTION

1. Field of the Invention

The invention relates generally to earth-boring rotating cone drill bits and, more particularly, to drill bits having structures aimed at improved drilling rate and extended life span.

2. Description of the Prior Art

The basic design for a rotating cone drill bit is described in a patent filed in 1933, Scott et. al. "Three Cone Bit," U.S. Pat. No. 1,983,316 (1934) and hasn't substantially changed or been substantially improved in concept since that time.

Rotating cone drill bits are used to drill wellbores for, e.g., oil and gas explorations. The most common types of rotating cone drill bits are three-cone rotating cone drill bits, which have three substantially cone-shaped cutter elements rotating on solid journals retained by ball bearings about their respective legs which are three segments which are fabricated into the bit body. The rotations of the cones are slaved by the rotation of the drilling string or mud motor or electric motor attached to the bit body portion (threaded pin end) of the rotating cone drill bit. Each cone has a plurality of inserts or teeth that disintegrate the earth formation into chips while the cones are rotating. Other types of drill bits, such as drag bits, also exist. In a drag bit, the cutting structures co-rotate with the drill string or mud motor or electric motor.

There are several factors which have limited the lifetime, durability and performance of drill bits as have been implemented in this conventional design over the last seven decades. A nonexhaustive listing of some of the inherent problems of the conventional rotating cone drill bit, which continue to this day, are listed below.

Problem areas have included the premature failure of the journal bearing which supports the cones as they rotate and the ball bearings that rotate between the journal and the cone retaining the cone.

One cause of such failures has been the leakage of abrasive drilling fluids and solids through the leg shirttail to cone shell gap into the bearings through the failed rotating seal caused by debris intrusion.

Another limitation of performance has arisen because of the loss of mud nozzles, obstruction of the hole bottom by debris inadequately cleared by the restricted mud flow, and the creation of hydraulic dead spots under the cones.

Bit lifetimes have been limited by the loss of cutting inserts and/or failure of cones due to loss of material in thinned areas of the cone shell.

Penetration rates have been limited due to inherent limitations on the cutter volume and cutting structure design which could be obtained on the cones, insufficient hydraulics, a faulty cone retention system, sealing the bearing, bearing properties, and a small bearing contact area causing high unit loads reducing the weight on bit.

Mud flows from the mud nozzles has been deflected and lost efficiency due to unavoidable interference from the cones and cutting structures, causing inter alia debris to be pushed back underneath the cones to be recut.

Cones are subject to wobble and gimbal as the bearing, which is poorly retained in position by the means of Scott's 1934 patented ball bearing retention design which wears out quickly resulting in a tapered, out-of-gage well bore section that must be re-drilled, and cutting inserts that become chipped, broken and/or dislodged.

Wobble of the cones as their bearings wear out which causes the cones to move in and out on their axes pumping grease out of the bearing and sucking or drawing mud into the bearing resulting in accelerated bearing wear, accelerated bearing wear is also caused by high unit loads and poor metallurgy which results in overheating and cone loss causing premature drill bit failure.

The retention balls in the bearing "brinell" the ball races like a ball peen hammer, accelerating cone loss and is one of the causes of premature failure of the bearing before the end of the wear-life of the cutting structures.

The ball retention design for retaining the cones on the journals removes material from the cone cross section further weakening the cone shell.

In insert type bits the cones utilize cutting inserts with differing grip depths, profiles, and grip diameters in order to be accommodated on the cone shell thereby rendering inserts vulnerable to breakage, loss by erosion, and reduced insert retention force due to less grip volume for resistance to rotation and dislodging forces. The required mud grooves defined in the cone created the need for additional erosion inserts to guard the roots of the cutting inserts, which in many cases were lost in any case due to root undercutting inherent in the mud flow along the grooves. When drilling, with a three cone rotary drill bit, the required weight on the drill string (as high as 75,000 pounds) is directly communicated to the drill bit cone shells and their cutting structure(s) as it rotates on the bottom of the hole being drilled. In traditional three cone rotary drill bits the larger diameter cones require radial clearance grooves to be defined in the cones surface in order to provide clearance for the cutting structure(s) of the adjacent cones. The required clearance grooves subsequently create small, and highly loaded, radial ribs, that serves as the load bearing surface area (riding on the hole bottom) which also serves as the insert retention area/cutting structure support area. By reducing the cone shell surface area in contact with the hole bottom to radial ribs (as a result of the required radial clearance grooves) the area in contact sees significantly higher unit loads which in turn causes accelerated wear. The required radial clearance grooves remove a substantial amount of material from the cones cross section further weakening the cone shell. The required radial clearance grooves also have another detrimental effect on the remaining radial ribs. As the cones rotate on the wellbore bottom (riding on the radial ribs), debris are entrapped in the clearance grooves and a portion of these debris are extruded out of the grooves and in between the inserts causing a powerful continuous erosive effect to the radial ribs/cutting structure support area/insert retention area additionally accelerating the rate of wear in this area. The resulting accelerated wear and wash-out of the remaining ribs undermines the insert retention area/cutting structure support area causing a loss of retention area, retention force, and ultimately loss of the cutting structure itself. With the reduction in support material the TCIs (tungsten carbide inserts) rotate, break, and dislodge causing the drill bit to fail prematurely. As an attempt to correct this condition, builders of conventional three cone rotary drill bits, add small "protection inserts" to the remaining radial ribs surrounding the cutting inserts with little or no positive results.

Radii of the leg-to-leg journal is limited in the conventional design thereby limiting journal strength and load capability.

Cutting inserts are press fitted into conventional cones, which limits the insert grip force and imposes damaging shear forces on the insert hole walls and exposes the unsupported portion of the cutting insert to high press forces during insert installation potentially causing micro fissures in the insert leading to early field failures.

The fabrication method of the leg/body segments which are three pieces welded together to form the bit body of conventional designs creates misalignments which causes the details of geometry of each bit to be individualized or untrue to varying degrees.

Conventional rotary cone bits include a short-travel rubber equalizer diaphragm in the grease loop that is directly exposed to the drilling environment which is easily subject to tampering. The conventional grease filling procedure entraps air in the bearing zones of the bit, the entrapped air compresses as the bit travels down hole due to increasing atmospheric pressure due to increasing mud weight thereby causing the equalizer to go the full length of its short travel or compensation prematurely, resulting in the failure of the equalizing lubrication system for the bearing.

The critical bearing and abrading surfaces of conventional three cone drill bits are typically uncoated and have only the friction resistance, hardness, and toughness, of the parent and/or wear pad material which may be heat treated and/or case hardened.

BRIEF SUMMARY OF THE INVENTION

In one embodiment of the invention the inserts into the cone of the roller cone bit are thermally fitted into the cone at a uniform depth, regardless of where the insert is placed on the cone, instead of press fit as is the prior art practice. In particular the illustrated embodiment includes a cutter assembly for a rotating cone drill bit having a plurality of cutter assemblies, each cutter assembly comprising: a journal having an axis; and a cone arranged and configured to rotate about the axis of the journal, the cone characterized by having a shell thickness and by having a plurality of cutting structures on the cone. The cutting structures comprise a plurality of inserts, where the shell thickness is sufficient to permit a uniform depth of grip as adjusted by a fisheye effect and a uniform grip diameter between the cone and each of the plurality of inserts when thermally fit into the cone regardless of the location of the insert on the cone, so that the thermal fitting of inserts provides a greater cone shell cross section for the same insert grip length due to the reduction of larger lead chamfer on the inserts as compared to traditional press fit methods, effectively allowing reduction of the cone cross section and allowing a reduced overall external envelope size of the cone to create a larger debris clearing volume between the plurality of cutter assemblies.

In another embodiment the journal is provided with a cylindrical main portion and a terminal spindle. The cone, which is made out of a nonbearing material, has fixed thereto both a nose cone bushing for bearing on the spindle and a retention bushing for bearing on the main portion of the shaft, instead of free floating bearings or bearings which are press fit or welded to the journal or spindle with the cone then bearing against these bearings. In particular, the embodiment includes a rotating cone drill bit comprising: a body; a plurality of legs coupled to the body; a corresponding plurality of rotating cones carried by the legs. The cones are composed of a nonbearing material. Each leg has a corresponding journal onto which a corresponding cone is rotatably mounted. The journal has a cylindrical shape of a first diameter and a terminal cylindrical spindle of a second diameter less than the first diameter. Each cone has a cone nose bushing composed of bearing material, fixed to the cone and providing a bearing surface for rotatably coupling the cone with the spindle. Each cone has a retention bushing composed of bearing material, fixed to the cone and providing a bearing surface for rotatably coupling the cone with the bearing surface with the journal.

In another embodiment the journal on the legs to which the rotating cones are coupled is flared where it is joined or integrally extends from the base of the leg. The leg in turn is coupled to the bit body. A contoured retention bushing is employed on the base of the journal at the flared transition to the leg. This permits the retention bushing to be brought flatly or close to the leg notwithstanding the flare, thereby allowing a greater effective length of the journal to be rotatably coupled to the cone. In particular the illustrated embodiment includes a rotating cone drill bit comprising a body; a plurality of legs coupled to the body; a corresponding plurality of rotating cones carried by the corresponding plurality of legs, where the cones are composed a nonbearing material. Each leg has a corresponding journal onto which a corresponding cone is rotatably mounted. The journal joins with the leg with a surface defining a journal-to-leg transition having a smooth radius of curvature of increasing diameter moving from the journal to the leg providing increased journal-to-leg strength. A retention bushing is fixed to each cone rotating on a corresponding journal and has a bearing surface between the retention bushing and journal. The retention bushing has a contoured surface adjacent to the journal-to-leg transition to allow the cone to be proximately positioned to the leg at minimal separation. Various types of rings can be used to retain the retention bushing on the journal without denigrating the bearing surface between the retention bushing and journal.

The journal has a cylindrical shape of a first diameter and a terminal cylindrical spindle of a second diameter less than the first diameter, each cone having a cone nose bushing composed of bearing material, fixed to the cone and providing a bearing surface for rotatably coupling the cone with the spindle.

Thermally fitted mud nozzles, which are tapered along their entire length on both the outside and in the interior bore and which extend between the roller close and close to the well bottom bore, allow for a laminar of mud to the cutting volume to allow for improved chip removal. The thermal fitting of the extend mud nozzles provides for their retention over welded or press fitted installations of mud nozzles, which would likely soon fail, be eroded out of the bit body and lost. The illustrated embodiment in particular includes an improvement in a rotating cone drill bit for drilling a wellbore having a wellbore bottom while utilizing drilling fluid, comprising: a bit body with an axis; a plurality of rotating cones mounted on the bit body; and a plurality of mud nozzles extending from the bit body and thermally fit into the bit body. Each mud nozzle has an exit orifice within a predetermined distance of the wellbore bottom. The predetermined distance measured on a line parallel to the axis of the bit body between the center of exit orifice and the wellbore bottom being in the range of 2.25 inches ±1.00 inch. Each of the mud nozzles is arranged and configured to extend past the cones and inserts to deliver the mud flow unimpeded to the well bottom bore without interference from the cones and inserts. Each mud nozzle has an inlet orifice and has a uniformly tapered interior shape along the entire length of the interior, expanding toward the inlet orifice to facilitate laminar flow within the mud nozzle.

In another embodiment what is provided is an improvement in a drill bit having at least one rotating cone comprising a plurality of elements with at least one of the plurality of elements rotating with respect to another one of the plurality of elements. One element is fixed to the cone or being is the cone itself and is composed of iron and is carbon free, so that wear of the one and other one of the plurality of elements is reduced, sparking between them is avoided and a threshold of galling between them is increased.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 4A is a perspective view with the cone portion of the cone-leg assembly shown in cross-sectional view along a medial plane 4A-4A denoted in FIG. 4B. FIG. 4B is a plan view of the cone-leg assembly as seen from a line of sight looking into the axis of the cone. FIG. 4C is a side plan view of the cone-leg assembly with the cone removed. FIG. 4D is a side plan view of the cone apart from the remaining portion of the cone-leg assembly.

FIG. 5A is a perspective view with the cone portion showing holes of the cone-leg assembly shown in cross-sectional view along a medial plane 5A-5A denoted in FIG. 5B. FIG. 5B is a plan view of the cone-leg assembly as seen from a line of sight looking into the axis of the cone showing insert holes. FIG. 5C is a side plan view of the cone-leg assembly with the cone removed. FIG. 5D is a side plan view of the cone apart from the remaining portion of the cone-leg assembly showing the insert holes.

FIG. 6A is a side view projection of the leg.

FIG. 6B is a side cross-sectional view of the leg as seen through medial plane 6A-6A of FIG. 6C, and FIG. 6C is an end plan view of the end of the leg and leg shank which connects to the body with an end view of longitudinal groove 440.

FIG. 8A is a perspective view, FIG. 8B is a side cross-sectional view as seen through section lines 8B-8B of FIG. 8C, and FIG. 8C is an end plan view.

FIGS. 9A and 9B illustrate apertures in the leg for welding access and for lubricating the cone-leg assembly after welding. FIG. 9A is a partially cut-away perspective view of the leg, showing a side cross-sectional cut away of the leg. FIG. 9B is a perspective view of the outside surface of the leg. FIG. 9C is a perspective illustration of the plug used to seal the lubrication bore. FIG. 9D is a perspective illustration of an guide pin used to align the leg to the bit body.

FIG. 10A is a perspective view from the bottom of the equalizer valve housing, FIG. 10B is a longitudinal side cross-sectional view of the valve body with the valve core removed as seen through section lines 10B-10B of FIG. 10C, and FIG. 10C is a end plan view of the bottom of the valve housing body.

FIG. 11A is an end plan view of the bottom of bit body shown before assembly with any other drilling elements. FIG. 11B is a side cross-sectional view of the bit body as seen through section lines 11B-11B of FIG. 11A. FIG. 11C is a side cross-sectional view of the one piece bit body as seen through section lines 11C-11C of FIG. 11A. FIG. 11D is an end plan view of the top of the bit body.

FIG. 12A is a side cross-sectional view of the first type of cone without inserts showing the positioning of the hole rows and cone profile along the medial plane 12A-12A of FIG. 12B. FIG. 12B is a front plan view of the first type of cone without inserts showing the positioning of the holes in the cone. FIG. 12C is a back plan view of the first type of cone without inserts showing the positioning of the holes in the cone. FIG. 12D is a partial side cross sectional view of the first type of cone without inserts showing the positioning of the holes in the cone taken through lines 12E-12E in FIG. 12C. FIG. 12E is a schematic side view of the first type of cone showing the positioning of the hole rows in the cone.

FIG. 13A-13D show the second type of cone of the three cone rotating bit from different views. FIG. 13A is a side cross sectional view of the second type of cone without inserts showing the positioning of the hole rows and cone profile along the medial plane 13A-13A of FIG. 13B. FIG. 13B is a front plan view of the second type of cone without inserts showing the positioning of the holes in the cone. FIG. 13C is a back plan view of the second type of cone without inserts showing the positioning of the holes in the cone. FIG. 13D is a schematic side view of the second type of cone showing the positioning of the hole rows in the cone.

FIG. 14A is a side cross sectional view of the third type of cone without inserts showing the positioning of the hole rows in the cone and cone profile along the medial plane 14A-14A of FIG. 14B. FIG. 14B is a front plan view of the third type of cone without inserts showing the positioning of the holes on the cone. FIG. 14C is a back plan view of the third type of cone without inserts showing the positioning of the holes in the cone. FIG. 14D is a schematic side view of the third type of cone showing the positioning of the hole rows in the cone. FIG. 14E is a partial side cross sectional view of the third type of cone without inserts showing the positioning of the hole rows taken through lines 14E-14E in FIG. 14C.

FIGS. 19*a* and 19*b* are orthogonal side plan views of a first type of cutter used in the gage rows of the cones, while FIGS. 19*c* and 19*d* are orthogonal side plan views of a second type of cutter used elsewhere on the cutter surface of the cones. FIGS. 19*e* and 19*f* are end and side plan view of the heel inserts used in the heel of the cones.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
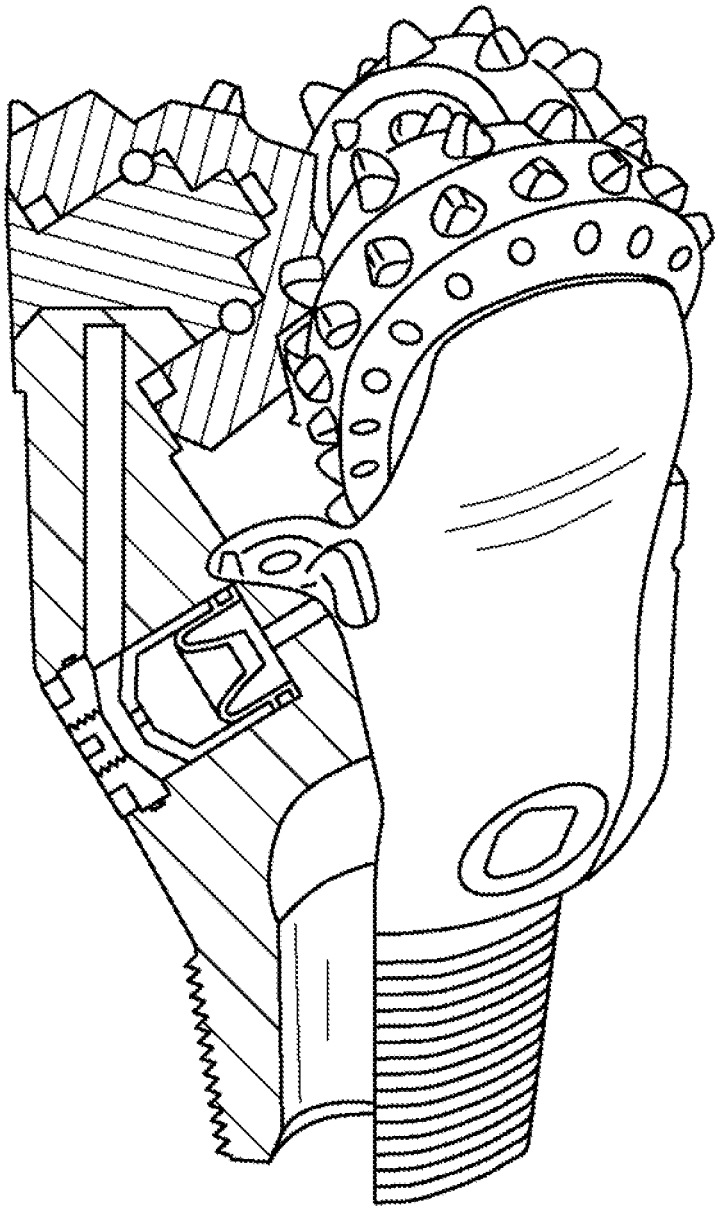
FIG. 1 PRIOR ART
FIG. 1 shows a side, partially cut-away, perspective view of a three-cone rotating cone drill bit in the prior art.

A conventional three-cone rotating cone drill bit of FIG. 1 is characterized by limited cutting rates in terms of rate of penetration (ROP) through formations, by uneven loading, by difficulty of assembly, by irregularities and limitations in the hydraulics, by lack of retention of inserts and cones, by limitations in the choice of materials because of weldability and construction requirements, and by the limited weight capacity of the bearings. A rotating cone drill bit in accordance with illustrated embodiments of the invention overcomes a number of drawbacks of conventional drill bits. Drill bits in accordance with embodiments of the invention have achieved an increased rate of penetration (ROP) by a minimum of 50% greater than conventional drill bits.

Figure 2:
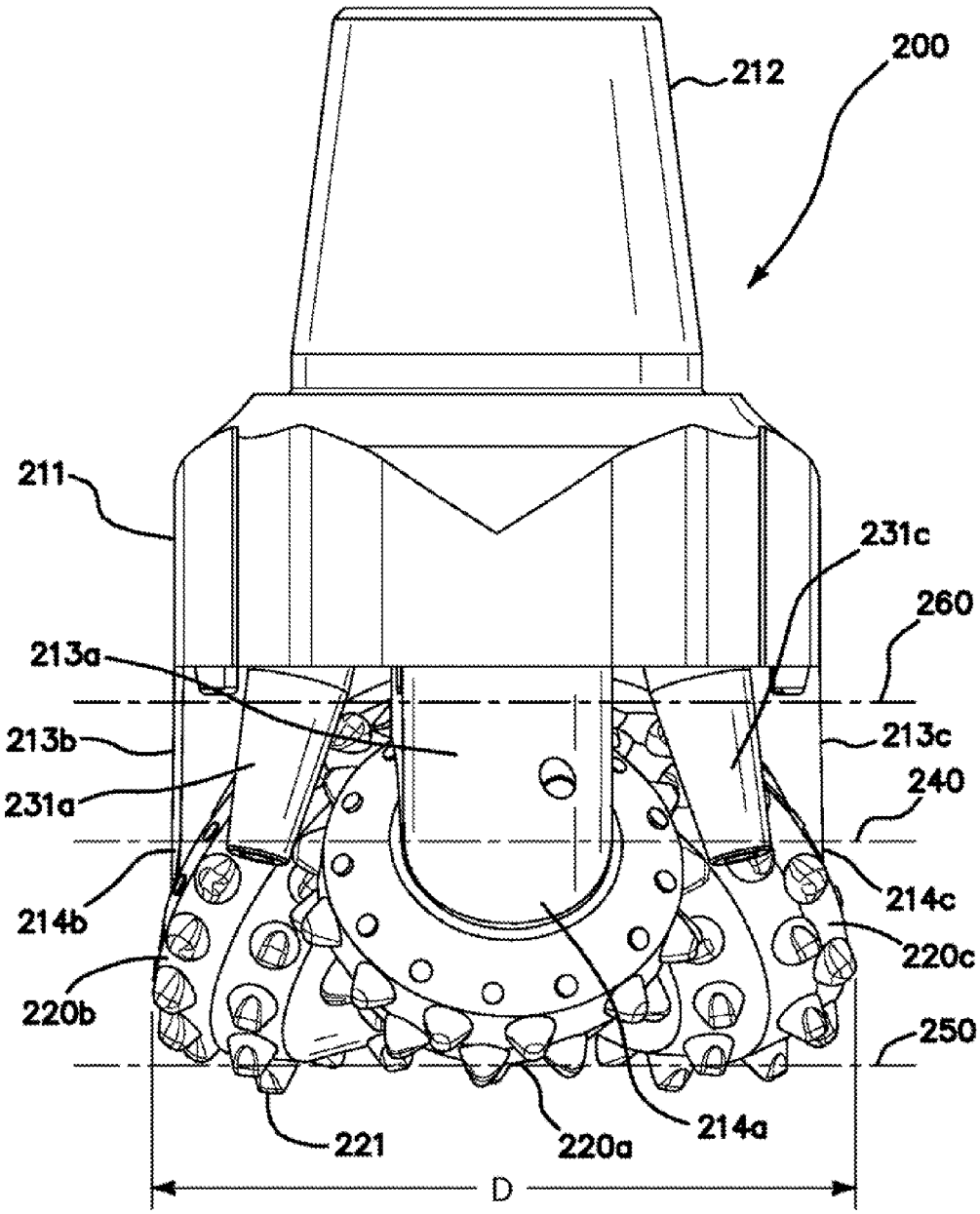
FIG. 2 shows a side perspective view of a three-cone rotating cone drill bit in accordance with an embodiment of the invention.
Figure 6A:
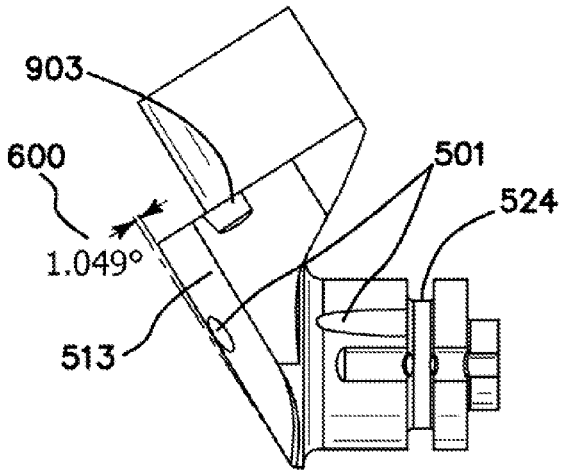
FIGS. 6A-6C are views of the leg separately shown from the cone-leg assembly.

A preferred embodiment of the three-cone rotating cone drill bit 200 is illustrated in FIG. 2. The drill bit 200 includes an upper threaded portion 212 for connection to one end of a drill string (not shown) or other means for rotating the bit, such as a turbine, electric, mud motor, or flexible drive. Three legs 213*a*-213*c* are coupled to the bit body 211. Each leg 213*a*-213*c* includes at its distal end (from the body) 211 an outer shirttail portion 214*a*-214*c*. The legs 213*a*-213*c* have back tapers and the leg back face has a full radius, thus increasing the bit-to-hole-wall annular clearance, reducing friction and aiding the release of cuttings and eliminating the requirement for leg back-face protection, for example, hard facing and protection inserts as required in traditional drill bits. As best illustrated in the cross-sectional view in FIG. 6A, the back taper angle 600 is in the range of a few tenths of a degree to 6 degrees, and preferably is about 1.049 degree.

Each leg 213*a*-213*c* has a corresponding cone 220*a*-220*c* mounted thereon. The shape of cone 220*a*-220*c* need not be geometrically conical, but in the illustrated embodiment assumes a multiple of conical sections or may even be free form. The outer envelope of cone 220*a*-220*c* is only substantially conically shaped in the broadest sense. Each cone 220*a*-220*c* may have a plurality of inserts 221 that form the cutting structures. It is to be expressly understood that although inserts on the cone are described by way of example, the invention is not limited to insert-type cutting structures. For example, teeth machined on the cones or cones with integrally formed cutting elements may also apply to the embodiments of the invention as described in greater detail below.

The drill bit 200 has a maximal diameter D depicted in FIG. 2 across the travel of the inserts as the cones rotate that defines the diameter of the wellbore to be drilled. Each of the cones 220*a*-220*c* has a maximal envelope diameter d illustrated in FIG. 4A. Conventional drill bits usually have a fixed cone-to-bit ratio, d/D. For example, a standard 7% inch drill bit has a maximum cone diameter of about 4 3/16 inch. In accordance with embodiment of the inventions, the cone size or diameter is reduced to allow for placement of a plurality of mud nozzles 231*a*-231*c* and to create a greater cross sectional area in the wellbore for debris clearance or flow paths. Two of the mud nozzles are shown for example in FIG. 2 (mud nozzles 231*a* and 231*c*, 231*b* is hidden) as extending to or near a plane 240 approximately half way between the bottom end 250 of the cones and the vertical top end 260 of the cones 220*a*-220*c*, or at least as far as the axial center of the base of the journal.

In another embodiment where the cone diameter and bit is reduced from that shown in FIG. 2, but the diameter of the mud nozzle exit orifice remains constant, the exit orifice may need to positioned above the plane 240.

In accordance with an embodiment of the invention, for a bit diameter D=7 7/8 inches, the maximum diameter of the cones, d, is about 3.975 inches or smaller, i.e., the cone size or maximal envelope diameter is reduced by about 5% or more as compared with conventional drill bits to allow advantageous placement of the one piece extended mud nozzles as described below.

Reduced-sized cones 220*a*-220*c* not only allow the exit orifices of mud nozzles 231*a*-231*c* to be placed at positions substantially between the cones 220*a*-220*c*, but also result in increased RPM of the cones 220*a*-220*c* about their respective journals given a drill bit RPM. In accordance with embodiments of the invention, the cones 220*a*-220*c* have an insert number density substantially the same as, or higher than that of conventional drill bits. Accordingly, with the increased cone RPM, bits of the invention provide more wellbore bottom strikes per bit revolution for the same amount of inserts or teeth. Further, the bit loading is increased. All these contribute to an improved rate of penetration (ROP) and lower the cost per foot (CPF).

The reduced cone size of the present invention also allows the cones 220*a*-220*c* to have a greater shell thickness which allows in turn substantially convex surfaces to be defined on the cones without the need for grooves defined therein as do the conventional drill bits. Conventional three-cone rotating drill bits have larger diameter cones. Grooves in the prior art cone shell are thus required to provide clearance of the intermeshing cutting structures from the surface of the neighboring cones. With a reduced diameter cone the need for any such clearance grooves is eliminated.

Without the grooves, the cones 220*a*-220*c* according to the present invention have more uniform shell thicknesses and are substantially stronger than the conventional cones. Further, conventional drill bits require protection teeth near the grooves to protect the inserts from the undercutting from abrasive wear and force of debris flowing through the grooves. These protection teeth require metal removal and do not add to the ROP, and have only limited effectiveness in protecting the inserts near the grooves. Subsequently, the inserts near the grooves are subject to a heavy abrasive undermining erosive force eroding away the cone shell near or at the insert root, which reduces the amount of retention force, allowing rotation of and dislodging of these inserts, and ultimately leading to breakage and to the loss of inserts and cone cracking.

Figure 3A:
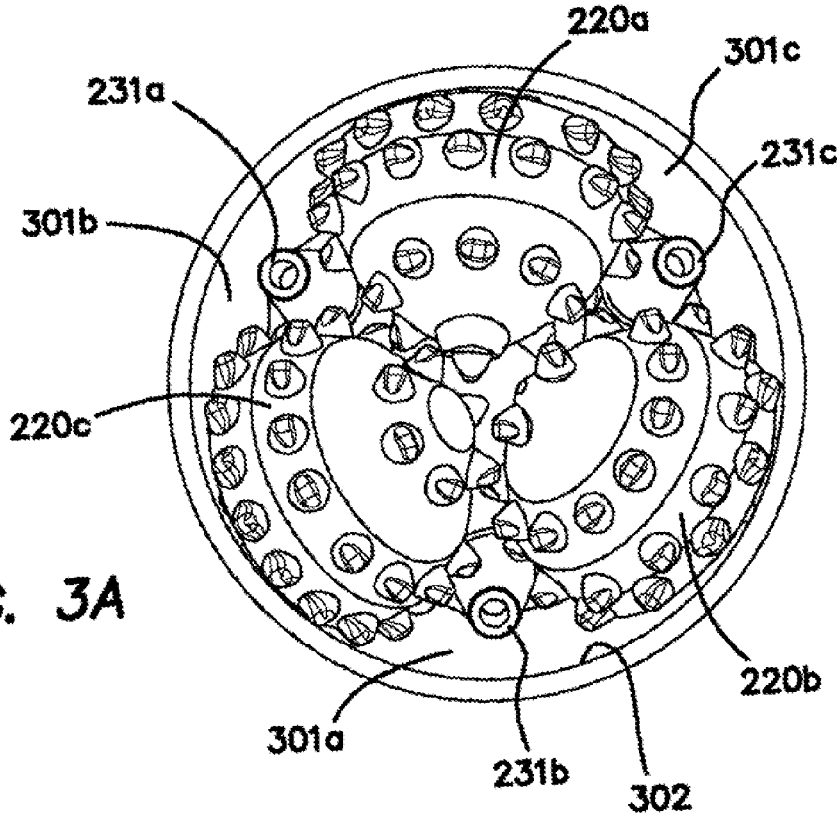
FIG. 3A shows a bottom perspective view of the drill bit of the invention within the circular outline of the wellbore hole as seen looking upward into the bit.

The reduced diameter cone according to the invention also advantageously results in a greater clearance between the drill bit 200 and the side wall of the wellbore for drilling fluid and cuttings to flow through. As shown in FIG. 3A, clearance areas 301*a*-301*c* are formed between the wellbore surface 302 and the reduced-size cones 220*a*-220*c*. In accordance with a preferred embodiment of the invention, as shown in FIG. 3A, a clearance area of 10% or more in the total wellbore cross sectional surface area is obtained as an unobstructed and free flow path for debris.

By contrast, when viewed from a top view, a conventional drill bit FIG. 1 would have its perimeter substantially filled with obstructing metal structures. Mud flow together with cuttings would be blocked from freely flowing in the wellbore perimeter. Drilling debris are forced by the prior art designs continuously downward following the mud flow and pushed back underneath the cones to be re-cut, thus reducing the ROP and the life span of the drill bit. Further, the larger cones and the cutting structures of the prior art drill bit also block the mud from the exits of the conventional drill bit.

A conventional three-cone rotating cone drill bit has mud nozzle inserts positioned such that the cones and their cutting structures tend to obstruct or block the mud flows from directly hitting the wellbore bottom. The prior art mud nozzle inserts are typically situated at a relatively large distance from the wellbore bottom in contrast to the design in the illustrated embodiment shown in FIG. 2, the conventional mud nozzle inserts have the following drawbacks: a. The mud jet force, flow, and pressure at the wellbore bottom is greatly diminished by the increased distance from the mud nozzle insert exit to the wellbore bottom; b. The cutting structure/cones are obstructions to the mud jet, intermittently and/or consistently blocking the mud jet from directly reaching the wellbore bottom; c. Drilling debris such as chips and cuttings are continuously forced back underneath the cones to be re-cut. All these lead to a degraded rate of penetration (ROP) and shortened bit life.

Although some conventional drill bits offer "extended mud tubes fitted with jet nozzle inserts" the attempt to direct the mud flow around the cones, the mud flows are still obstructed by the cutting structure/cones, and the mud flows from the drill pipe to the tips of the jet nozzles and the curve or bend defined between the mud passageways in the drill bit and the mud nozzles or within the mud nozzles themselves. The curve in the mud tube is necessary for the conventional extended mud tubes to pass around the larger cones this adaptation is optionally available only on 12¼ inch and larger bits at an extra cost. Additionally, conventional extended mud tubes are surface welded onto the bit body causing loss of metal integrity at the point of attachment, giving rise to failure of the welds by erosion causing failure of the hydraulics and ultimately the loss of the tubes and mud nozzle inserts. Conventional leg segments are electron beam welded (EBW) and/or stick welded together, forming the bit structure and mud courses, this method of assembly causes pits and holes in the interface of the mud courses which allows mud forces to drill through the flaws. Conventional drill bits use short carbide nozzle inserts retained in the mud tube by a threaded steel retainer or nail lock with a seal in the mud tube. In the conventional design the abrasive high pressure drilling mud has followed the pits and holes in the mud courses and washed out the mud nozzle insert retention system causing the loss of the nozzle. The new mud nozzles are (1) piece with a tapered I.D. hole and a taper on the exterior projection portion of the nozzle with no loose pieces and thermally fitted to the body eliminating weak inferior weld joints and pits and holes due to weld dilution. The new mud nozzles and courses provide a straight direct path to the wellbore bottom without interference from the cutting structure, cones, or courses in the body or mud tubes.

Figure 3B:
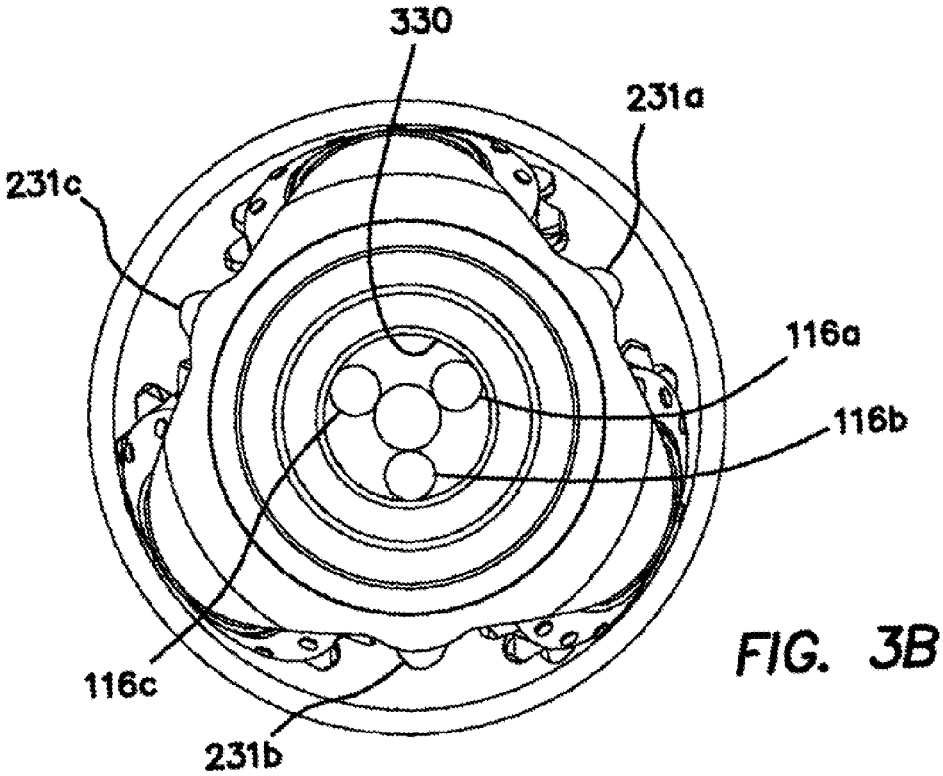
FIG. 3B shows a top perspective view of the drill bit of the invention within the circular outline of the wellbore hole as seen looking downward, the bit unconnected to the drill string.

In accordance with a preferred embodiment of the invention, as shown in FIGS. 2, 3A and 3B, a plurality of straight extended one piece mud nozzles 231*a*-231*c* are coupled into corresponding straight bores in the bit body 211. The mud nozzles 231*a*-231*c* can be fixed into the bit body 211 by means of thermal fitting, press fitting, welding, or threading. They are fixed to the body 211 and positioned to be aligned between the cones 220*a*-220*c* (before the legs 213*a*-213*c* and cones are assembled into body 211). When using thermal fitting, e.g. when the bit body 211 is heated, the temperature of fitting is controlled to be between 400° F. and 1000° F. or by exactly controlling the temperature differential between the fitted elements to be in the range of 300° F.-900° F. depending on the corresponding materials, the amount of fit needed, and the diameters of the fitted elements. The temperature range used in thermal fitting also means that a relatively high operational temperature in a down hole environment can also be tolerated without jeopardy to the structural integrity of the assembled bit, and also allows for a variety of high temperature materials to be used for the drill bit 200 without failure due to metal dilution caused by welding.

Each of the one piece extended mud nozzles has its longitudinal axis angled between 7 and 20 degrees, preferably about 14.86 degrees, from the longitudinal axis of the drill bit 200. In addition, the mud nozzles 231*a*-231*c* have a continuous exterior taper on the projecting portion narrowing down as the orifice is approached that allows extra space for chip release and clearance from the cones and cutting structures.

As seen in FIG. 3B, when viewed from the upper end of the mud bore 330, at an appropriate slanted angle, the one piece extended mud nozzles 231*a*-231*c* provide a substantially straight, direct and obstruction-free lines of sight or mud path flows, from the drill pipe through the bit body all the way to the exit orifices of the mud nozzles. In other words, mud nozzles 231*a*-231*c* are "see-through" mud nozzles. The straight flow provided through body 211 of bit 200 is better illustrated in the side cross sectional views of FIGS. 11B and 11C, where as shown a clear line of sight exists from the mud pipe connection 330 to the corresponding receptacles or bores 113*a*-113*c* defined in body 211 for the base of mud nozzles 231*a*-231*c* respectively as shown in FIGS. 3*a* and 3*b*.

For certain mud velocities, the flow in the mud nozzles 231*a*-231*c* is a substantially laminar flow. Violent, high-pressure, sweeping forces are directed toward the wellbore bottom without interruption from the cones 220*a*-220*c* or the cutting structures. Maximum exit pressure is preserved by the mud jets, which can now overpower the back flows and swiftly clear the wellbore bottom debris or cuttings. Thus, re-cutting of old chips is eliminated, allowing the drill bit to continuously penetrate fresh formation uninterrupted.

The mud jet or flow now has a direct path to the wellbore bottom. In addition, the mud nozzle exit orifice can be adjusted to a predetermined distance from the wellbore bottom for an optimized chip clearing effect by providing mud nozzles of the appropriate length. Eliminating hydraulic dead spots under the cones 220*a*-220*c*, and working in conjunction with the increased cone-to-cone clearance, and bit-to-hole-wall annular clearance, mud nozzles 231*a*-231*c* of the invention allow the cutting structure to continuously strike fresh formation as the cuttings or debris are easily and swiftly cleared providing a greater rate of penetration (ROP) and total footage drilled.

In accordance with a preferred embodiment of the invention, the basal portion of cone 220*a*-220*c* forms a shirttail guard which overlaps and wraps around the leg shirttail 214*a*-214*c* to divert abrasive drilling fluid and cuttings away from the gap between the cone 220*a*-220*c* and the corresponding leg 213*a*-213*c*, thus protecting the seal 531 located within the bearing, cone, or cone-leg assembly 213*a*-213*c* as described below. This is best illustrated in the perspective and cross-sectional views of a cone-leg assembly 400 as shown in FIGS. 4A-4D.

Figure 4A:
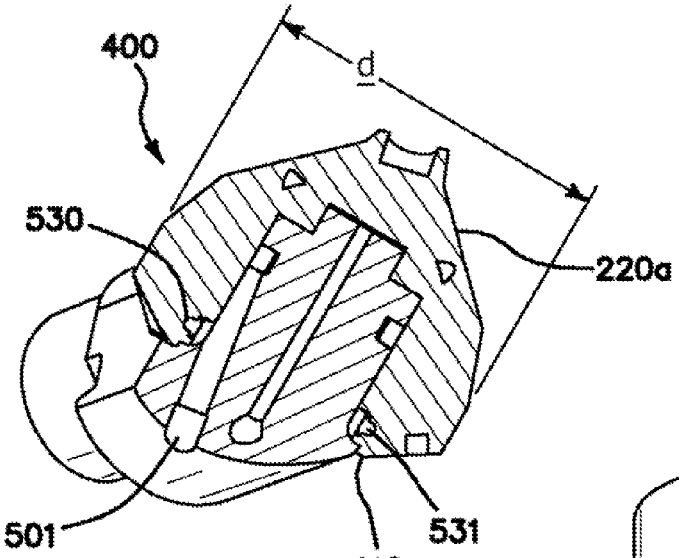
FIGS. 4A-4D illustrate a cone-leg assembly of the invention.
Figure 4B:
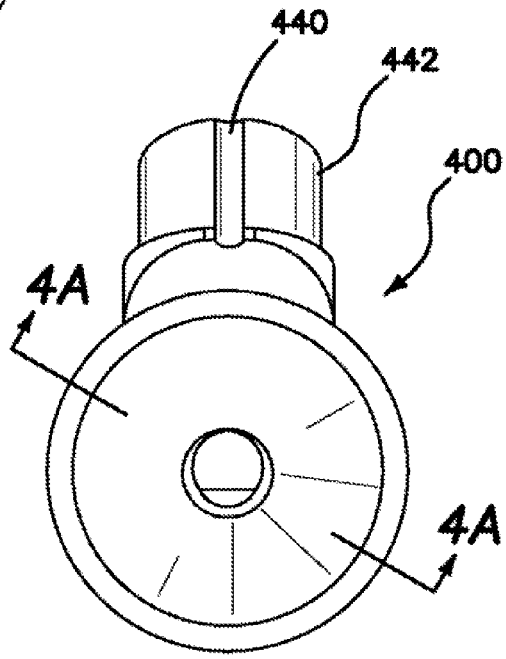
Figure 4C:
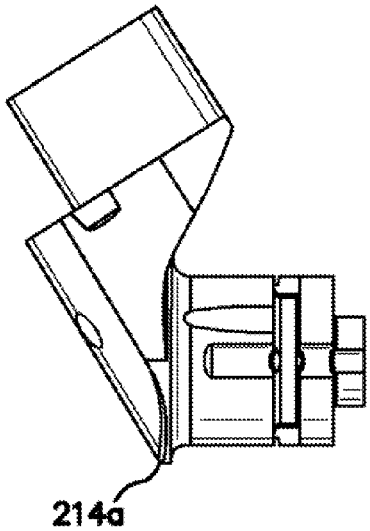
Figure 4D:
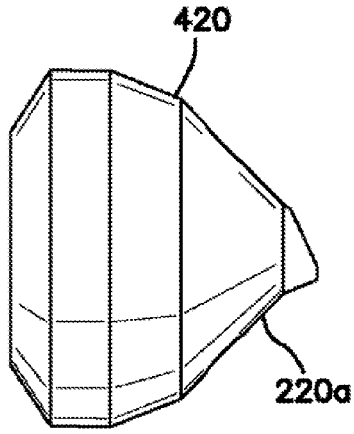

As shown in FIG. 4A, the cone 220*a*, for example, has a shirttail guard portion 410 that extends over a portion of the leg shirttail 214*a* at the distal end of the leg protecting the leg shirttail. The shirttail guard portion 410 substantially wraps around or covers the gap or clearance space between the leg shirttail 214*a* and the rotating cone 220*a*. As described below there are three types of cones 220*a*-220*c*, but for simplicity only one of the types is described here, and the description is equally applicable to all three types.

Conventional drill bits have their cone-leg assembly interiors directly exposed to the wellbore environment. Abrasive drilling fluids and solids enter the interface and the seal area, causing premature failure of the seal and journal bearing and ultimately resulting in shortened bit life.

The shirttail guard portion 410 of the cone 220*a*-220*c* in accordance with embodiments of the invention diverts the drilling fluids and cuttings around, and away, from this gap eliminating direct impact and packing of debris into the seal zone. Thus, the seal 531 located within the cone-leg assembly 400 is protected. This increases the seal life, and subsequently increases the life of the journal bearing and extends the life span of the entire drill bit 200 as shown in FIG. 2.

In accordance with embodiments of the invention, the legs 213*a*-213*c* each has a longitudinal groove 440 on the leg shank 442 matching a guide pin 942 when installed in the bit body 211, to achieve a "true geometry" or positive, definite alignment in the drill bit. The grooves 440 and guide pins angularly align the cone-leg assemblies 400 located at predetermined positions into the true geometry of the design relative to the bit body 211. The guide pins are placed in the bit body bores 114*a*-114*c* in FIG. 11A and protrude above the surface of the body to engage the corresponding grooves in the legs for alignment prior to engagement as the body is heated and are then keyed into the groove 440 in leg shank 442 before the lower end of the leg shank 442 enters its corresponding bore in the bit body and remains keyed into groove 440 as the leg shank 442 continues to be lowered into its corresponding receiving bore while the cone-leg assembly 400 is being thermally fitted to the heated bit body 211 FIG. 11A. The time available for any adjustment for positioning between the bit body 211 and cone-leg assembly 400 is very limited until the thermal differential in size between the mating parts is lost and the cone-leg assembly 400 is frozen into the bit body 211. Guide pin and groove is a keyway combination to insure that an accurate angular orientation, true geometry, between the bit body 211 and cone-leg assembly 400 is established before thermal insertion and is continuously maintained at all times during thermal fitting to completion.

FIGS. 5A-5D further illustrate the cone-leg assembly in relationship to a plurality of holes 510 defined into the cone 220*a* for receiving inserts or cutting elements. The holes 510 are configured to receive inserts (such as inserts 221 shown in FIG. 2) in a thermal fitting process. Thermally fitting inserts 221 into the cones 220*a*-220*c* in accordance with embodiments of the invention, in place of press fitting as done conventionally, reduces the amount of lead chamfer required on the insert 221. This reduction in chamfer effectively increases the insert grip length for a hole 510 of the same depth. By carefully controlling the temperature range, e.g., 400° F.-1000° F. or by exactly controlling the temperature differential between the fitted elements to be within 300° F.-900° F. depending on the corresponding materials, the amount of fit needed, and diameters of the fitted elements to accommodate the differential temperature expansions of various materials, insertion forces are essentially non-existent because inserts 221 which are not heated are in free clearance when placed into the hole 510 during the actual thermal fitting. Thus, the insert 221 does not shear or skive the wall of the hole 510 during the installation reducing damage to the insert hole wall which increases grip force. Thermal fitting provides greater retention force on the total insert grip length for the same amount of fit due to 100% grip engagement and eliminates the possibility of insert damage due to high hydraulic press forces, as is currently used in the industry.

Further, in one embodiment of the invention the cones or the retention bushings within them of the rotating cone drill bit are comprised of a material having a thermal conductivity approximately in the range of 30.0-76.0 BTU/hr-ft−° F. Be—Cu is an example within this range. However, it must be expressly understood that any material having a thermal conductivity within this range may be equivalently substituted. The high thermal conductivity of the cones or retention bushings maintains the temperature of the bearings between the cone and leg journals at the ambient temperatures, namely at the mud temperatures obtained down hole.

Figure 5A:
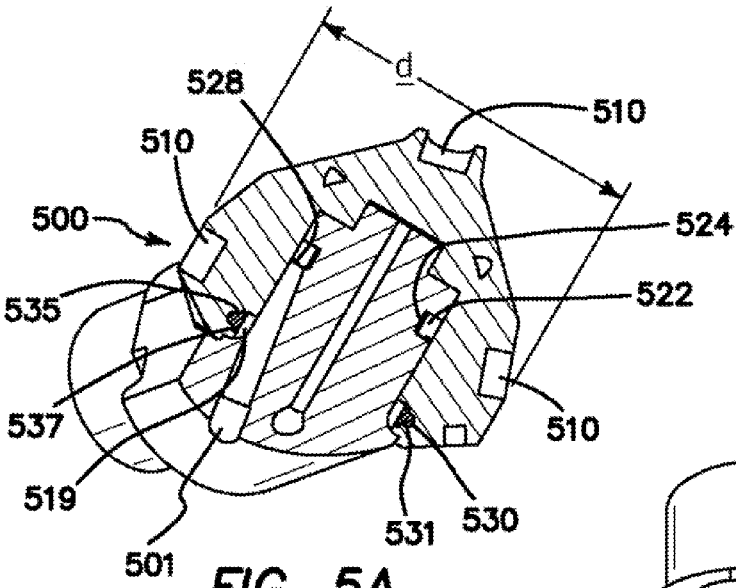
FIGS. 5A-5D illustrate a cone-leg assembly of another embodiment of the invention.
Figure 5B:
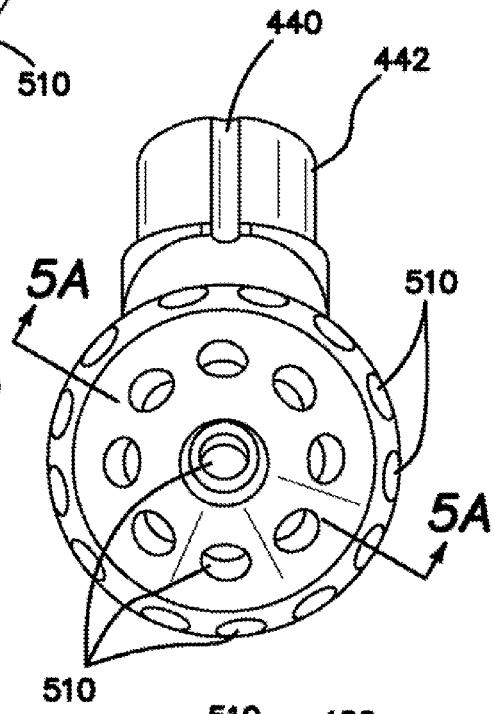
Figure 5C:
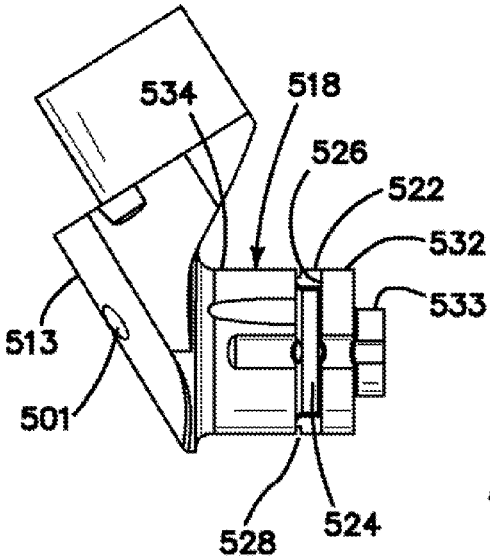
Figure 5D:
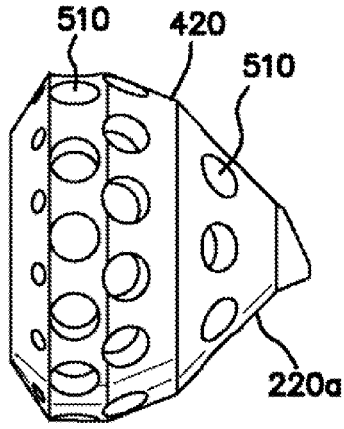

In further accordance with a preferred embodiment of the invention, the journal 518 of the leg 513 as shown in FIG. 5A is fitted with a seal riser bushing 519 at its base by way of, for example, thermal fitting, welding, etc. As best illustrated in the cross-sectional views in FIG. 7, the seal riser bushing 519 has an interior surface 519*s* with a gradually increasing radius from the journal 518 toward the leg 513 as shown in FIG. 5C. In other words the journal and leg are connected by a smooth contoured surface instead of an abrupt cylinder-to-cylinder transition. Such a seal riser bushing 519 reduces the abruptness of the transition from the leg 513 to the journal 518. In other words, the journal-to-leg radius ratio is effectively increased, strengthening and increasing the overall strength of the leg assembly. Also as a result of the seal riser bushing, the increased bearing length of journal 518 is not sacrificed for the increased journal-to-leg radius. In addition, the seal riser bushing 519 provides an optimal O-ring sealing surface, raising the surface of the seal above the journal surface as discussed further below allowing for increased Weight-On-Bit which allows for a increase in the Rate-Of-Penetration.

Conventional three cone drill bits have a significantly smaller journal-to-leg radius ratio than disclosed in the illustrated embodiment. In addition, the right-angled transition between the journal and the leg in the prior art designs causes uneven stresses near the transition, reducing the strength and weight carrying capacity in conventional cone-leg assemblies, all of which are avoided by the above design.

Figure 8A:
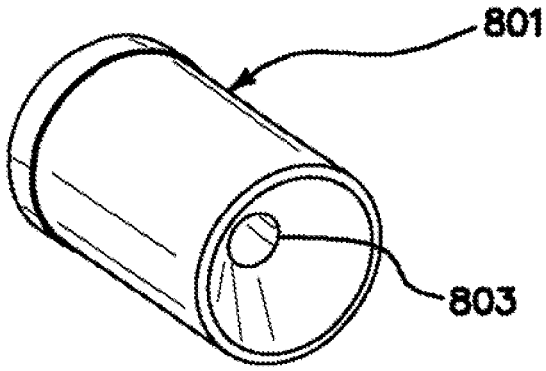
FIGS. 8A-8C show a hollow step pin for securing the bushing.
Figure 8B:
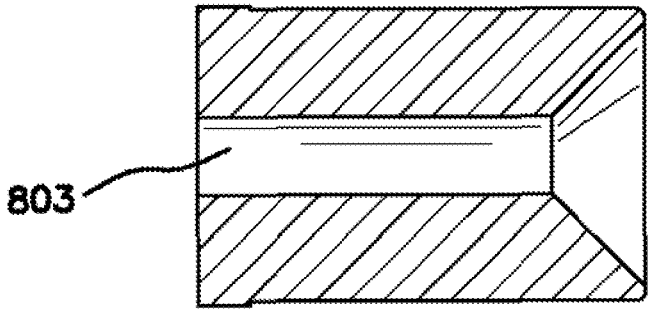
Figure 8C:
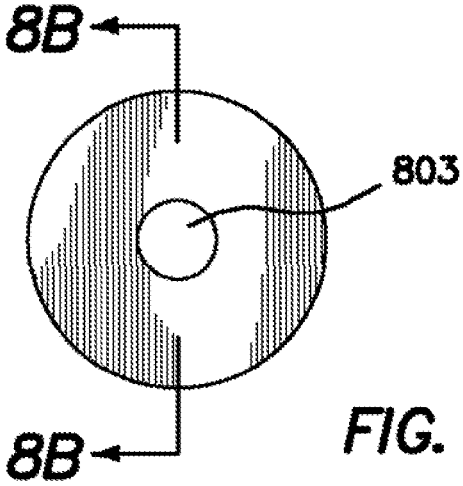

Through an electron beam welding access bore 501, as best illustrated in FIG. 9A, a relief surface or recess 601 in FIG. 9A is formed, as necessary, in which a hollow step pin is fitted or pressed. The weld access bore 501 in FIG. 9A also effectively increases the I.D. of the bushing 519 slightly at a predetermined location adjacent the welding access bore 501 as shown in FIG. 9A. The step pin 801 shown in FIGS. 8A-8C is disposed in the welding access bore 501 and is mechanically fitted or coupled to the bushing 519, further preventing the bushing 519 from rotating or moving axially relative to the journal 518 as an added means of securing the bushing 519 to journal 518 by means of thermal fitting between the two parts. See FIG. 9A. The step pin 801 may be fixed into the bore 501 by way of, for example, welding, press fitting, or thermal fitting. The O.D. of the bushing 519 may further be machined as necessary.

As shown in FIG. 5C, a retention segment 522 is disposed into a retention groove 524 on the journal 518. The retention segment 522 may comprise two half rings, or any number of arcs, either symmetrically or asymmetrically divided. The retention segment 522 is precisely fit into groove 524 to reduce operating clearances and freely rotates therein after being fixed to the cone. The retention segment has a shoulder with a smaller width than the groove 524, and is oriented so that the ring shoulder is pushed against the distal surface 526 of the groove 524, away from the proximal groove surface leaving a gap or clearance 528 facing the weld access bore 501. The gap 528 is used as a weld relief area, and prevents the retention segment 522 from being inadvertently beam welded onto the journal 518 from which it must be left free to rotate.

Figure 7:
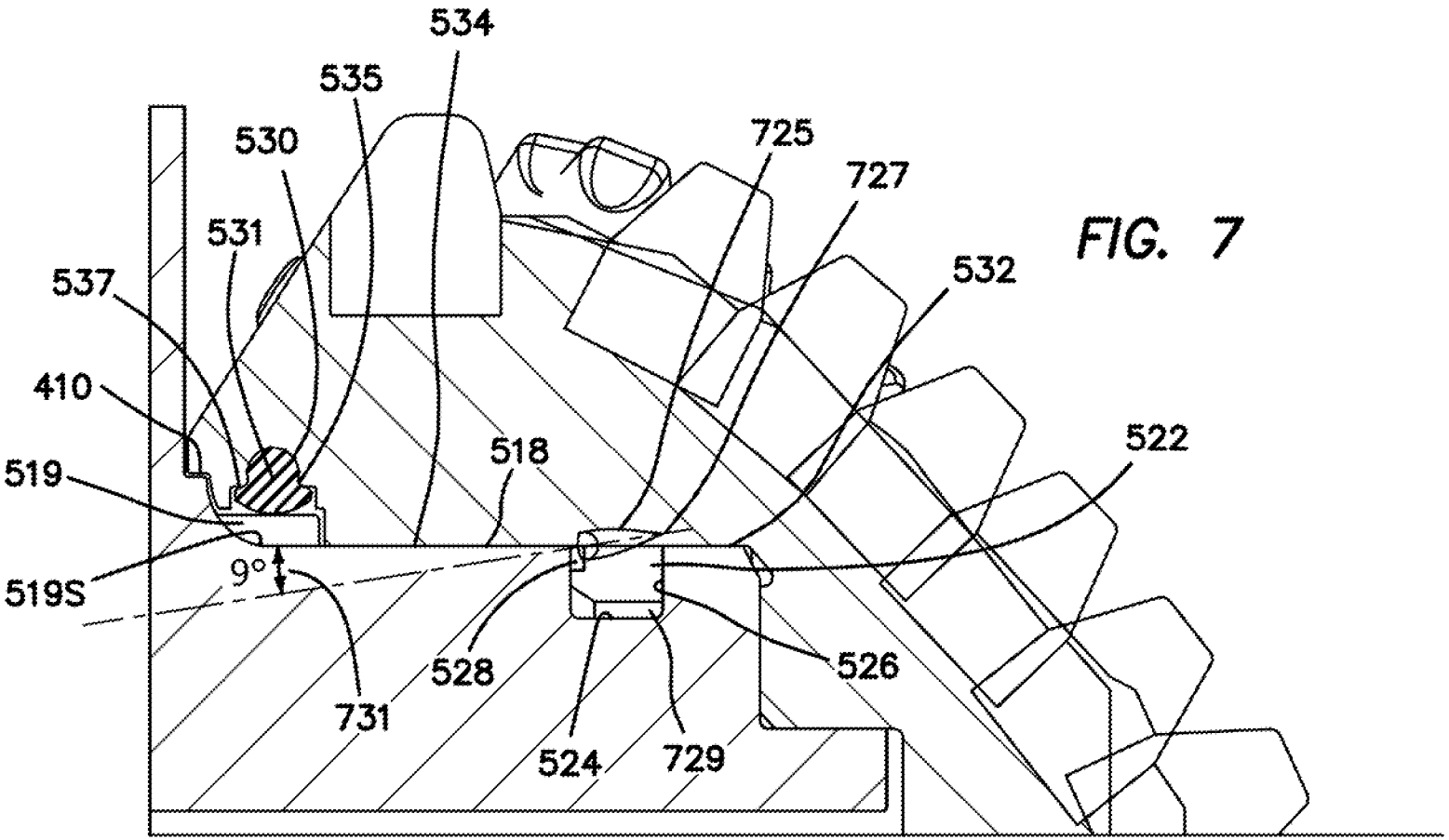
FIG. 7 is a cross-sectional side view of the journal, cone, and upper half of a seal riser bushing and according to an embodiment of the invention half of an annular retention segment mounted within the groove formed in the journal pin.

It is to be noted that the retention segment 522 has an O.D. slightly smaller than that of the cone I.D. by, e.g., 0.0001-0.018 inch and the retention segment is closely fitted to the cone ID to eliminate the possibility of weld dilution due to excessive clearances. In addition, as shown in FIG. 7, a clearance 729 also exists between the retention segment 522 and the inner surface of the groove 524, allowing for a secondary grease reservoir.

An O-ring seal in FIG. 5A is fit into the I.D. of the O-ring gland 530 in cone 220*a*. The cone 220*a* including the O-ring seal 531 is pushed onto the bushing 519 in FIG. 5C. The surface of the journal 518 and the bushing O.D. 519 may optionally be slightly lubricated. In each of the embodiments gland 530 is manufactured in the form depicted in FIGS. 4 and 5 and described in U.S. Pat. No. 4,776,599, which is incorporated herein by reference. Not previously appreciated is the fact that the opening of gland 530 facing seal riser bushing 519 is provided with rounded edges or corners 535 at its aperture to provide a smooth transition from an interior of the O-ring gland across the edges to an adjacent flat surface surrounding the aperture to avoid nibbling the O-ring during operation and is provided with an adjacent flat surface or flats 537 opposing seal riser bushing 519 to reduce extrusion of the O-ring and to protect the seal from nibbling when a portion of the O-ring is extruded out of the gland 530 by varying clearances during rotation of the cone.

It is noted that the I.D. of the O-ring seal 531 is larger than the O.D. of the journal 518, since the seal riser bushing 519 provides an elevated sealing surface above the surface of journal 518. In accordance with an embodiment of the invention, the maximum clearance between the O-ring seal and the journal surface is about 0.141 inch constant 360 degrees. Thus, contact between the lubricated O-ring seal 531, the journal surface 518, and retention segments 522 is avoided during the installation process, preventing contaminations to the welding area on the retention segment O.D. adjacent to the gap 528 which insures weld integrity.

In conventional drill bits, the running diameter of the bearing and O-ring seal may be the same. During cone installation, the O-ring seal is subject to smearing and/or scraping forces that may cause damage and/or contaminate the seal or welding surfaces, which is avoided by the illustrated embodiment.

Next, an energy beam such as an electron beam is directed through the beam bore 501 to weld the retention segment 522 onto an inner surface of the cone 220*a*-220*c*. As shown in FIG. 7, the weld area 725 is elongated along the direction 727 of the energy beam through bore 501. The depth and the width of the weld area 725 as shown has an approximate ratio of 1.2:1 to 3.0:1 Similar materials, e.g., Be—Cu or Be—Ni, are used for the retention segment 522 and the cone 220*a*-220*c*. When electron beam welding is used, the cone-leg assembly 500 may need first to be cleansed with acetone, and demagnetized to avoid defocusing of the electron beam. Any beam welding method known may be substituted for electron beam welding.

The cone is rotated during the beam welding, thus forming a solid, electron beam welded member extending up to a 360 degree arc that fixes the retention segments to the cone and thus maintains the cone in its intended longitudinal position on the journal, while allowing free rotation about the journal. During drilling, as a result of the lack of freedom of motion other than rotating about the true axis of journal 518, the drilling of a tapered hole is avoided. Without the wobbling or gimballing motion of a loose cone that appears in conventional drill bits, the bit of the present invention drills a substantially parallel or constant diameter hole from top to bottom.

Welding the retention segments 522 to the cones also effectively adds a thick strengthening rib to the cones 220*a*-220*c*, increasing the overall strength of the cones. Further, as shown in FIG. 5C, the journal 518 according to the invention has a front main radial bearing surface 532 in addition to the rear main radial bearing surface 534, and spindle 533. The greater bearing surface area as compared to prior art journal designs also results in greater bearing life of the cone-leg assembly 500, thus extending the life span of the drill bit.

Most conventional drill bits use ball bearings for cone retention in the cone-leg assembly that allows the cones to wobble as they rotate due to the operating clearances that are required for the ball bearings, leading to a tapered, out of round, wellbore that requires re-drilling. In addition, conventional cones move longitudinally in and out on the leg journal, causing uneven drilling paths and cause inserts to chip, break, and/or dislodge, cracking the cones in the process, and allows grease to pump out and mud to be sucked past the O-ring seal and into the bearing.

Even in the conventional drill bits that employed electron beam welding, failures of the bits occurred as a result of the weld angle being too acute, which in turn resulted in a small fusion interface zone at the retention weld interface on those test bits, which led to catastrophic failure of the dozen test bits due to cone loss. The design was abandoned and was never offered commercially due to these cone loss failures that were directly related to the weld angle.

In accordance with embodiments of the invention, the angle 731 between the electron beam 727 and the longitudinal axis of the journal 518 as shown in FIG. 7 is between 3 and 15 degrees, and preferably about 9 degrees. This ensures a reasonable width-to-depth ratio of the weld area 725, and in turn ensures prescribed weld strength. In addition, the resulting weld is free of bearing intrusion contamination of the adjacent bearing surfaces.

Figure 6B:
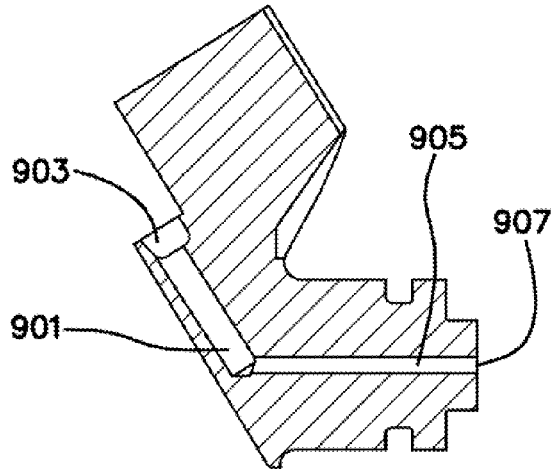
Figure 6C:
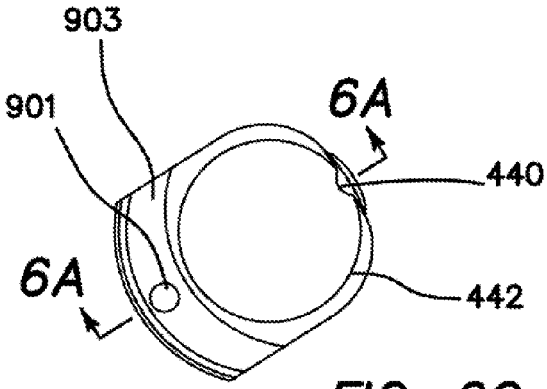

After the welding process which fixes the retention segments to the cone, the cone-leg assembly 500 is lubricated while the cone 220*a*-220*c* is slowly rotated. The lubricant is injected, for example, using a grease gun, from an lubricant access bore 901 in the leg 513 as shown in FIGS. 6B-6C. In accordance with an embodiment of the invention, the lubricant includes silver talc as an additive. The silver powder increases the lubricity and in the preferred embodiment the silver talc is mixed to a lubricant or grease prior to being heated and then injected into the drill bit.

The inlet of the lubricant access bore 901 is hidden in a mud groove 903 defined in the base of the leg as shown in FIGS. 6B-6C. While being injected from the inlet, the lubricant flows through the central passageway 905 of the journal 518, and exits from an outlet 907 at the distal end of the journal 518. The lubricant then smoothly applies to the bearing surfaces. Excess lubricant, carrying air pockets, exit or "burp" through and from the weld access bore 501. Such a full loop grease filling procedure completely removes entrapped air in the cone-leg assembly 500.

After bleeding off the excess lubricant and the air pockets, the welding access bore 501 is sealed with plug 909 shown in FIG. 9B. After securing the plug 909 into bore 501, any excess portion of the plug 909 may be cut flush with the surface of the leg 513 removing any protrusion.

Figure 10A:
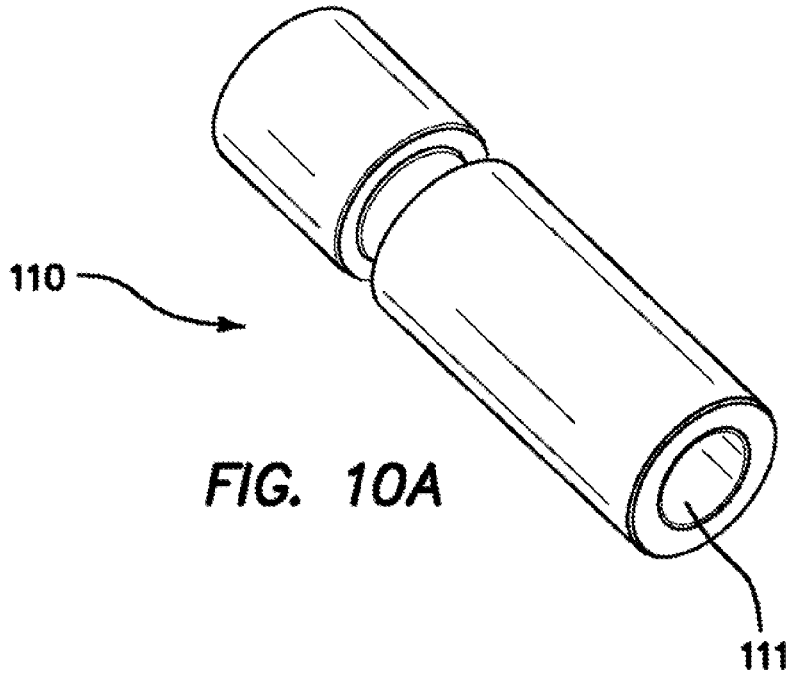
FIGS. 10A-10C illustrate a floating sealing equalizer valve housing of the invention.
Figure 10C:
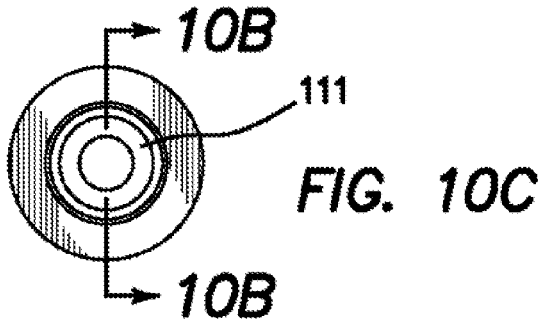
Figure 10B:
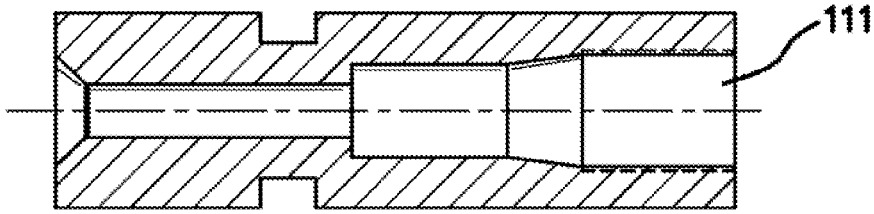

A floating, sealing, equalizer valve housing 110, as shown in FIGS. 10A-10C, uses a relief valve of a type similar to a conventional pneumatic tire valve. However, any sliding element; rolling ball, or other movable sealing member may be substituted. The relief valve is installed into the floating, sealing valve housing and after the grease filling procedure the valve assembly is disposed into lubricant access bore 901. The sealing equalizer valve 110 is a floating or movable equalizing valve, which is adapted with a seal to slide along the lubricant access bore 901 in responding to pressure changes. The equalizer valve 110 has a long travel to eliminate the possibility of the system failing from lack of pressure compensation during deep hole drilling. A conventional tire valve core is used to close the aperture 111 in FIG. 10B and to bleed off extra grease and/or air pressure if the pressure change is too extreme to be compensated by the equalizer valve 110 only.

The equalizer valve 110 is protected from direct exposure to the drilling environment to eliminate damage and the possibility of tampering as the access to bore 901 is hidden in the mud groove 903 as shown in FIG. 6B. The mud groove 903 also allows the valve 110 to be in fluid communication with the environment, thus communicating the down hole pressure to the valve 110 more effectively than conventional drill bits due to a greater zone of fluid communication.

A conventional three-cone rotating cone drill bit, by contrast, has an equalization system using a short-travel rubber diaphragm installed in a large bore in the leg back-face retained by a snap ring, directly exposed to the drilling environment, and is subject to tampering. The required large bore in the leg back face further reduces the legs strength and the bore itself is subject to wear and damage as the legs back face comes in contact with the wellbore wall or becomes damaged from debris trapped between the wellbore wall and the leg which creates a grinding action wearing the equalization system bore to a point where the snap ring fails failing the equalization system. Holes in the grease cover cap used in conventional drill bits to communicate the down hole pressure to the equalization system are small and easily plugged subsequently failing the equalization system which causes the premature failure of the bearing and bit. Conventional filling procedures also entrap air in the bearing zone. The entrapped air is compressed as the bit travels down hole, due to increased atmospheric pressure, causing the equalizer to reach its maximum travel range prematurely, and thereby failing the system.

Figure 11A:
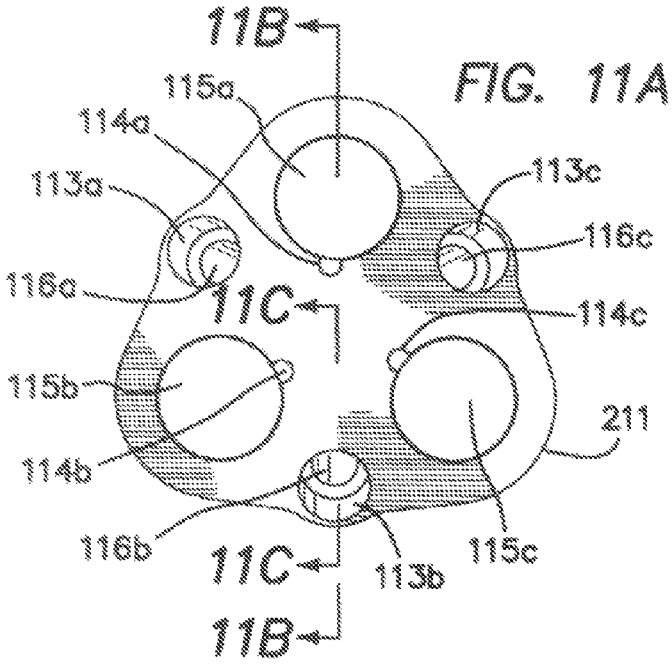
FIGS. 11A-11D show the one piece drill bit body including pre-manufactured holes for coupling the drill bit body with various components.
Figure 11D:
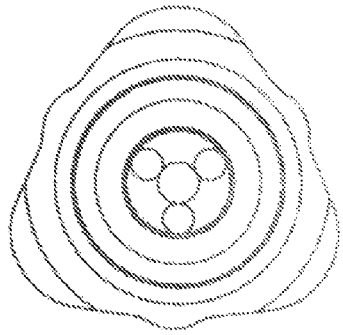
Figure 11B:
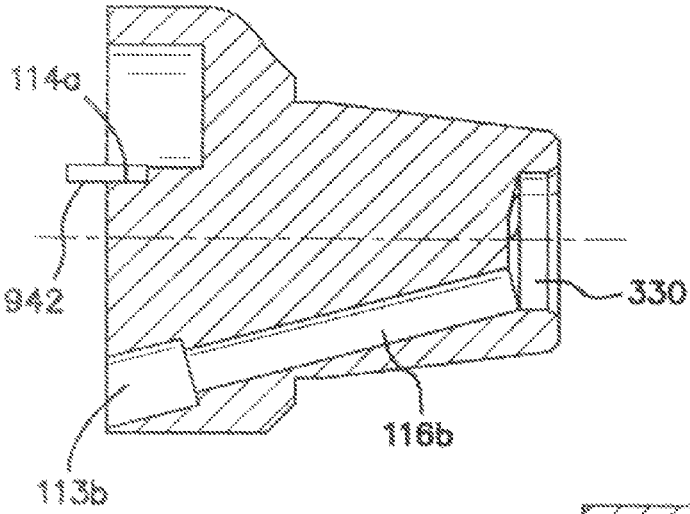
Figure 11C:
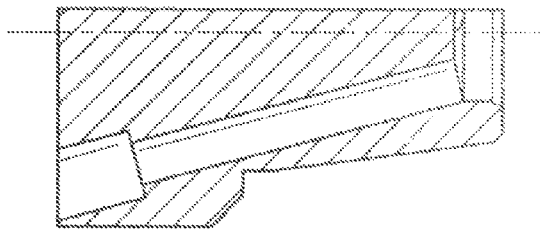

The "true geometry" assembly procedure in accordance with embodiments of the invention requires that the cone-leg assemblies 500 be assembled prior to installation into the bit body 211. Accordingly, the bit body 211 has pre-manufactured structures, as shown in FIG. 11A, to accommodate the installation procedures.

After the cone-leg assembly 500 is assembled, the drill bit 200 may be assembled. This is achieved by first thermally fitting the mud nozzles 231*a*-231*c*, as discussed earlier, into the corresponding mud nozzle bores 113*a*-113*c*, shown in FIG. 11A. Next, slotted, hollow guide pins 942 are fit into the bores 114*a*-114*c* in the body 211 and extend above the body bottom surface to engage leg groove 440 and align cone-leg assemblies 500 prior to installation. The guide pins determine the angular positioning of the cone-leg assemblies 500 to be coupled to the body 211, as the groove 440 on each leg 513 has to be oriented to match the guide pin prior to installing the cone-leg assembly 500. The guide pins also accurately control the angular cone-leg assembly offset relative to the bit body 211. The leg groove 440 and an air slot in the guide pin further provides air evacuation during the procedure of installing the leg shank 442 into the leg shank bores 115*a*-115*c* in the bit body 211 by providing a slot in the guide pin 942 and a clearance between groove 440 and the guide pin which communicates the ambient environment with bores 115*a*-115*c* in the bit body 211 as the leg shank 442 is inserted into the bores 115*a*-115*c*. The leg shank 442 may be fit into the bores 115*a*-115*c* in bit body 211 by thermal fitting and/or by press fitting.

In addition, the cone-leg assemblies 500 have to be installed in a proper sequence to avoid interference between the cutting structures of the cones 220*a*-220*c*. Each cone 220*a*-220*c* needs to be oriented to a predetermined position in order to clear the adjacent cones 220*a*-220*c* and their cutting structures. In particular, cutting structures on the cones 220*a*-220*c* need to be radially oriented prior to and during the axial installation of the cone-leg assemblies. The cutting structures on the three cones 220*a*-220*c* are intermeshed, i.e., in a clocked position after assembling. This is achieved by indexing each cone into a selected intermeshed configuration and passing the teeth of each cone through the intermeshed teeth of the other previously installed cones on the bit body. At least one or more combinations of selected intermeshed configurations are possible.

By contrast, traditional three cone rotating cone drill bits are comprised of three segments, which make up the entire support structure for the cones. The legs/body segments are radially assembled then welded together to form the entire bit structure. There is no requirement for specific sequence of assembling or for the cone orientations.

Figure 19A:
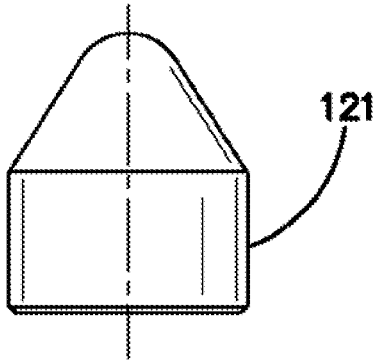
FIGS. 19*a*-19*f* are plan views of insert profiles.
Figure 19B:
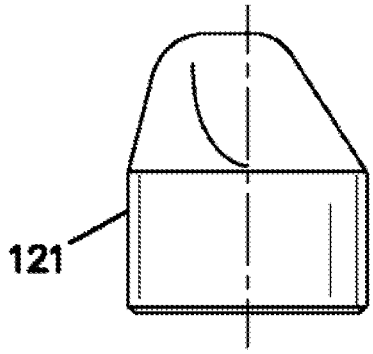
Figure 19C:
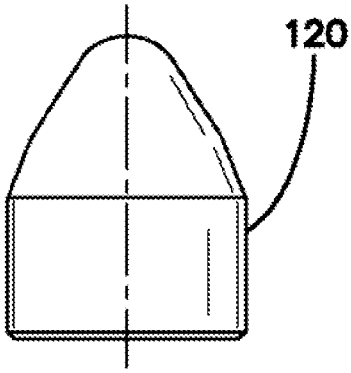
Figure 19D:
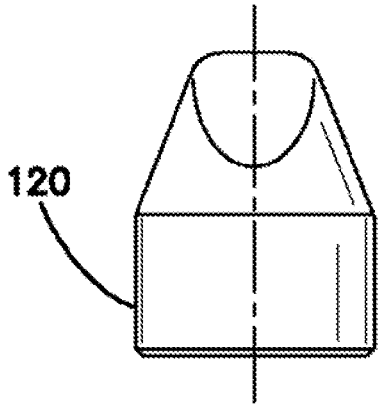

In accordance with a preferred embodiment of the invention, each of the cones 220*a*-220*c* have different, predetermined cutting structures and insert arrangements, as shown in FIGS. 12-14. There are A-E rows of cutters on the cones 220*a*-220*b* of FIGS. 12A-E and 13A-D, where the sockets or insert holes are depicted without the cutters inserted in them. The cone 220*c* of FIGS. 14A-E has A-D rows of cutters. As seen in FIG. 12C, which is a back plan view of cone 220*a*, and has an "A" row or heel row of insert retentions. As seen in FIG. 12A, which is a side cross-sectional view along the medial plane 12A-12A of FIG. 12B, the first cone 220*a* includes inserts in the other rows, i.e., "B" row, "C" row, "D" row, and "E" row, all of which have substantially the same diameter and depth or length in the roots of the cutting inserts. The B row serves at the gage row and has its center positioned in the illustrated embodiment at an axial distance of approximately 0.743 inch from the base of cone 220*a*. The C row has its center positioned in the illustrated embodiment at an axial distance of approximately 1.318 inch from the base of cone 220*a*, the D row center is at an axial distance of approximately 2.397 inch from the base of cone 220*a*, and the E row has its center at an axial distance of approximately 3.298 inch from the base of cone 220*a*. It is noted that the recesses 123 and 125 in the "B" row and the "C" row respectively appear in FIG. 12A to have smaller sizes at the bottom of the cross-sectional view of the cone 220*a*. This is merely a projection effect. A perspective view of cutter 120 used in rows C-E is shown in FIGS. 19C and 19D which appears in some of the figures when seen in perspective view as circular in outline. As shown in perspective views in FIGS. 2 and 3 cutters 120 have a conical and rounded chisel shape with opposing dihedral flats, which are oriented on the cones in a conventional manner. "B" row is the gage row and has a different projection profile for the cutter 121 employed there as seen in FIGS. 19*a* and 19*b* than in the other rows which use cutter 120 as seen in FIGS. 19*c* and 19*d*.

Figure 12A:
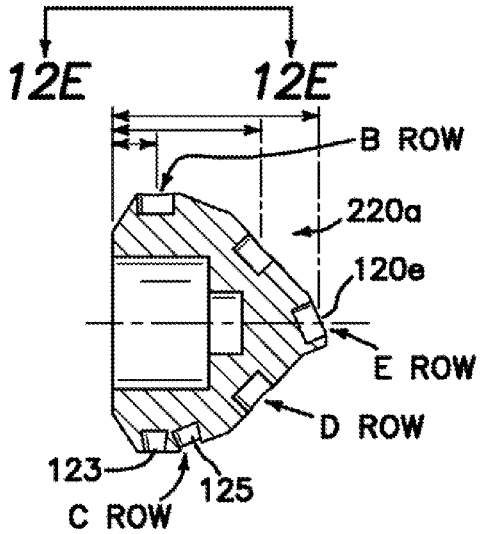
FIG. 12A-12E show a first type of cone on the three cone rotating bit from different views.
Figure 12B:
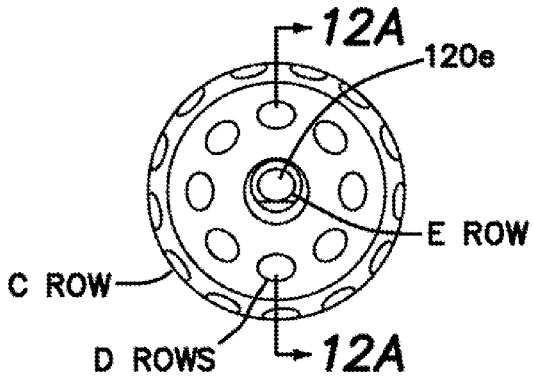
Figure 12C:
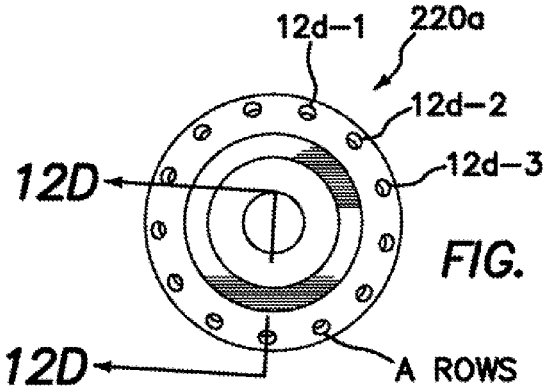
Figure 12D:
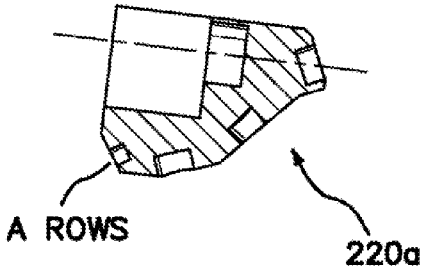
Figure 12E:
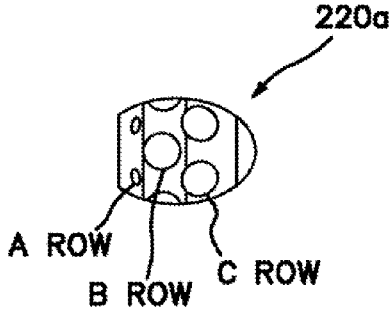
Figure 14A:
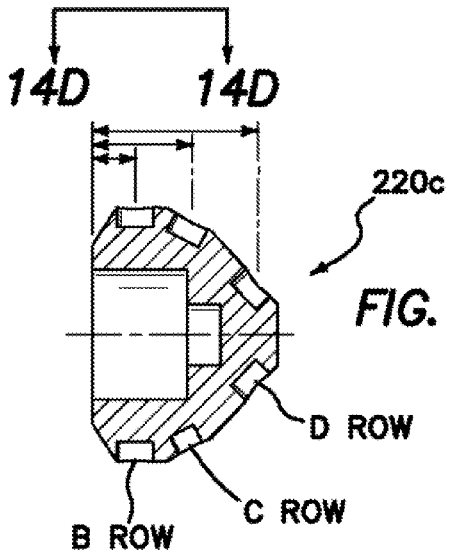
FIGS. 14A-14E show a third type of cone from different views.
Figure 14B:
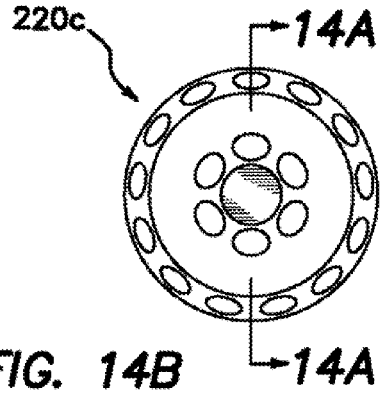
Figure 19E:
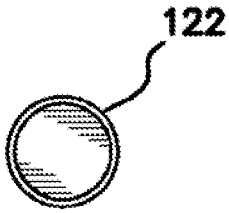
Figure 19F:
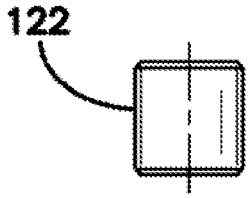

FIG. 12D is a partial side cross sectional view taken through lines 12D-12D in FIG. 12C which shows the placement of the "A" heel row in the side view, which cannot be seen in the different longitudinal side cross sectional view of FIG. 12A, which uses the inserts 122 as shown in FIGS. 19E and 19F. Similarly, FIG. 14E is a partial side cross sectional view taken through lines 14E-14E in FIG. 14C which shows the placement of the "A" heel row in the side view, which cannot be seen in the different longitudinal side cross sectional view of FIG. 14A. Here the axis of the "A" row inserts are about 33° inclined with respect to the longitudinal axis of the cone. The longitudinal slice shown in plan side view by FIG. 12E shows the azimuthally offset pattern between the "A", "B" and "C" rows of cone 220*a*; FIG. 13D shows the azimuthally offset pattern between the "A", "B", "C" and "D" rows of cone 220*b*; FIG. 14D shows the azimuthally offset pattern between the "A", "B" and "C" rows of cone 220*c*.

As shown in FIG. 12A, the "E" row on the nose of cone 220*a* has only one insert, and in FIG. 13A on the nose of cone 220*b* seen as the two holes 120*e*. Cone 220*a* in FIG. 12A has one nose insert 120*e*, preferably has its longitudinal axis slanted about 25° relative to the longitudinal axis of the cone and positioned off center as shown in FIG. 12B. Cone 220*b* in FIG. 13A has two nose inserts 120*e*, each preferably having their longitudinal axis slanted about 51° relative to the perpendicular to the longitudinal axis of the cone in the case of cone 220*b* and positioned off center as shown in the plan view of FIG. 13B. Cone 220*c* of FIGS. 14A-14E has no "E" row inserts.

The "D" row of cone 220*a* preferably has eight (8) inserts 120*d* distributed approximately at an equal distance from each other in FIG. 12B and eleven inserts 120*d* asymmetrically spaced from each other as shown in FIG. 13B in the case of cone 220*b*. Cone 220*c* has six inserts 120*d* distributed approximately at an equal distance from each other as shown in the front plan view of FIG. 14B. As shown in FIG. 13B inserts 120*d* are placed with 9 inter-insert spaces of 31.30°. Beginning at the top of FIG. 13B in the 12 o'clock position and moving clockwise, inserts 120*d* are spaced at 31.30° intervals for 7 spaces. Then the next inter-insert space is set at 39.15°. This then is followed clockwise by two more inter-insert spaces of 31.30° for a total of 9 such spaces. The spacings are then finished with a final inter-insert space of 39.15° returning to the starting position.

As best seen in FIGS. 12B and 12C the "C" and "A" row of cone 220*a* has thirteen (13) inserts 120*c* and 120*a* asymmetrically spaced on the cone 220*a*. There are 11 inter-insert spaces between inserts 120*a* and 120*c*. As seen in FIG. 12B starting with the start hole location at 12 o'clock to which the D row is aligned, a first insert 120*a*, 120*c* is offset counterclockwise 13.5° followed clockwise by 8 inter-insert spaces of 26.67°. The ninth inter-insert space is set at 33.33°. This is then followed clockwise by 3 more inter-insert spaces of 26.67°. The spacing then ends with a final inter-insert space of 33.33° with a return to the first insert 120*a*, 120*c* which is offset counterclockwise 13.5° from the start hole location.

The 11 inserts 120*a* and 120*c* of the A and C rows in the second type cone 220*b* is shown in FIGS. 13B and 13C and are equally spaced with 11 inter-insert spaces of 32.727°. The start hole location at the 12 o'clock position splits the first inter-insert spacing in half with a 16.37° offset. The B row has its center at an axial distance of approximately 0.743 inch from the base of cone 220*b*, the C row has its center at an axial distance of approximately 1.165 inch from the base of cone 220*b*, the D row has its center at an axial distance of approximately 2.026 inch from the base of cone 220*b*, and the E row has its center at an axial distance of approximately 3.011 inch from the base of cone 220*b*.

Figure 14C:
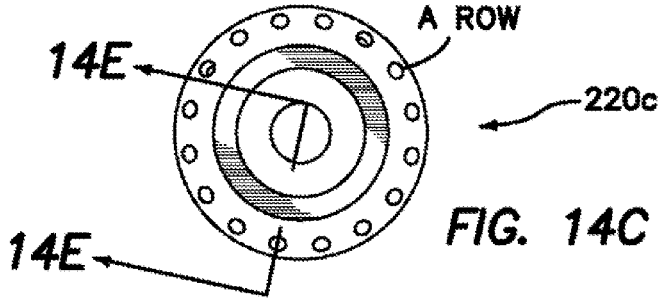
Figure 14D:
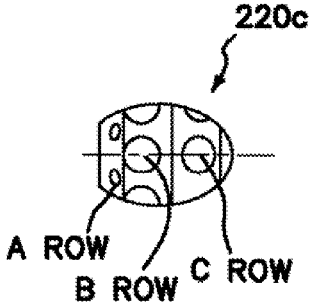
Figure 14E:
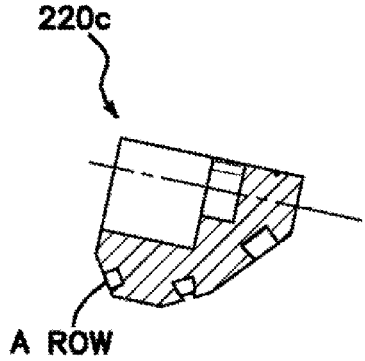

Similarly, the 16 inserts 120*a* of the A row in the third type cone 220*c* is shown in FIG. 14C and are equally spaced with 16 inter-insert spaces of 22.50°. The start hole location at the 12 o'clock position splits the first inter-insert spacing in half with a 11.25°. The B row has its center at an axial distance of approximately 0.743 inch from the base of cone 220*c*, the C row has its center at an axial distance of approximately 1.138 inch from the base of cone 220*c*, and the D row has its center at an axial distance of approximately 2.700 inch from the base of cone 220*c*.

The C row of the 13 inserts 120*c* for the third type of cone 220*c* is asymmetrically distributed as shown in FIG. 14B. Starting at the start hole location at 12 o'clock and moving clockwise there are 8 spaces with an inter-insert spacing of 26.67°. Then follows an inter-insert spacing of 33.33°. This in turn is followed clockwise by 3 more inter-insert spacings of 26.67° and is finished with a final inter-insert spacing of 33.33° returning to the start hole location.

Turning finally to the B row spacings of the cones 220*a*-220*c*, FIGS. 12A and 12E depicts the asymmetric spacing of 13 inserts 120*b*. The holes for inserts 120*b* are shown in FIG. 12A, but the spacing is marked in FIG. 12E where the insert holes are not visible due to perspective. There are a total of 11 inter-insert spacings of 26.67°. Starting again at the start hole location at 12 o'clock and moving clockwise, there are 7 inter-insert spacings of 26.67° followed by an inter-insert spacing of 33.33°. This is then followed clockwise by 3 more inter-insert spacings of 26.67° followed again by an inter-insert spacing of 33.33°. One more inter-insert spacings of 26.67° brings the distribution of inserts 120*b* back to the start hole location.

The 11 inserts 120*b* of the B row in the second type cone 220*b* is shown in FIG. 13B and are equally spaced with 11 inter-insert spaces of 32.727°. The start hole location at the 12 o'clock position marks the position of the first of the inserts 120*b* in cone 220*b*.

The 16 inserts 120*b* of the B row in the third type cone 220*c* is shown in FIG. 14B and are equally spaced with 16 inter-insert spaces of 22.50°. The start hole location at the 12 o'clock position marks the position of the first of the inserts 120*b* in cone 220*c*.

The insert or tooth patterns of FIGS. 12A-14D illustrate a preferred embodiment of the tooth intermeshing pattern of cones 220*a*-220*c*, which allows cones 220*a*-220*c* to rotate relative to each other without interference given their reduced diameters and relative orientations. However, it is to be understood that many other tooth intermeshing patterns may be chosen without departing from the spirit and scope of the invention.

Physical vapor deposition (PVD) processes may be applied to coat a variety of surfaces of the various surfaces of the drill bit 200. These surfaces may include, but are not limited to, the bearing surfaces, the cone shells, the cutting structures integral to the cone base or shell, the retention segments, the seal riser bushing, and the mud nozzles. PVD results in a harder, tougher surface made of, e.g., TiAlN, and/or a surface with additional friction-reducing lubricity, and consequently an extended life span of the drill bit 200.

In accordance with a preferred embodiment of the invention, cones 220*a*-220*c* with cutting structures integral to the cone shell are coated in a PVD process. This is particularly advantageous for embodiments of the invention where teeth are machined from the surface of a cone 220*a*-220*c*.

Figure 15:
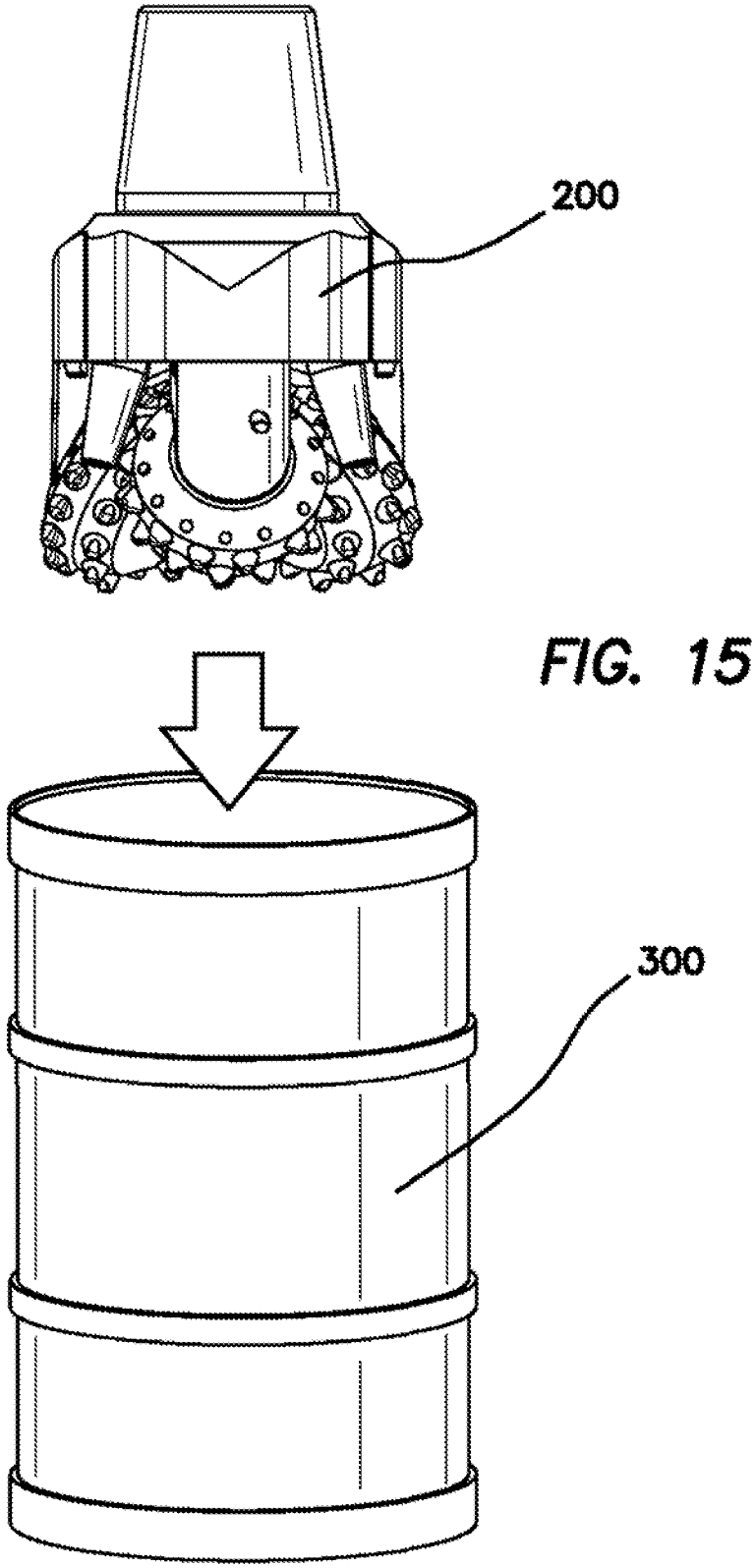
FIG. 15 is a perspective side view of a protective shipping container for the drill bit, which container is shaped in the form of a miniature oil drum.
Figure 20:
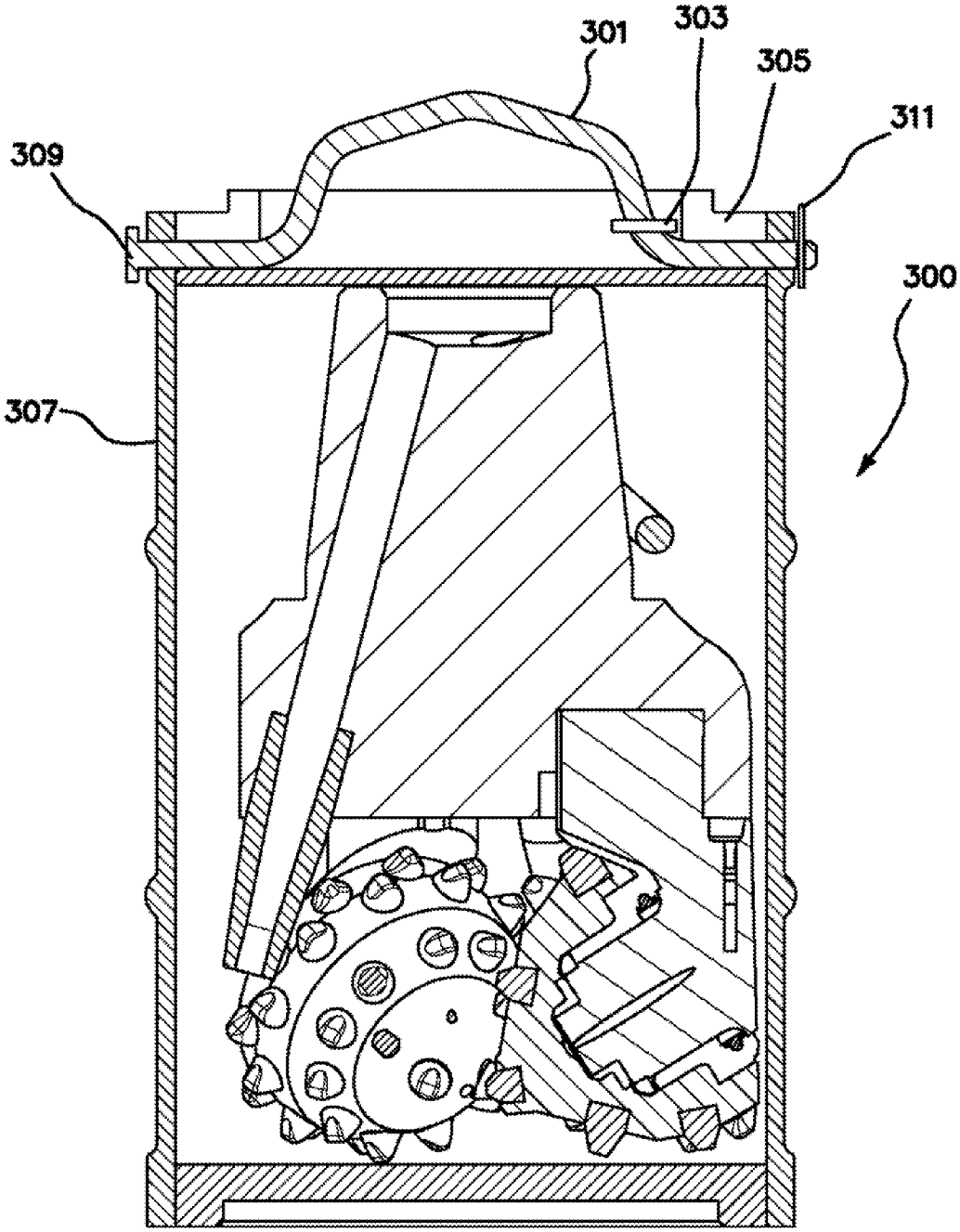
FIG. 20 is a side cross sectional view of the container shown in FIG. 15 with the drill bit placed inside and the lid of the container closed.
Figure 21:
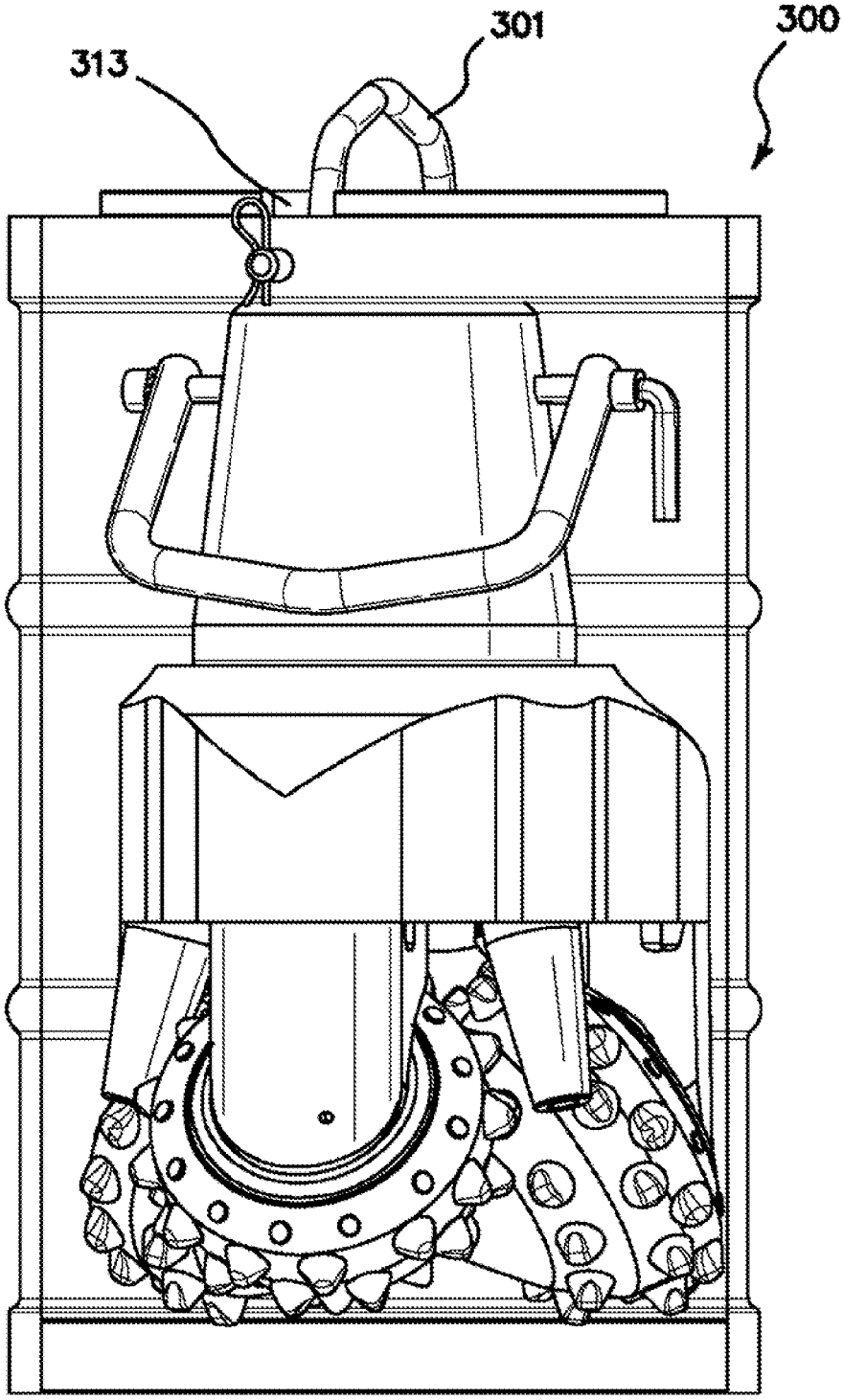
FIG. 21 is a side cross sectional view of the container with the drill bit placed inside rotated slightly from the perspective shown in FIG. 20.
Figure 22:
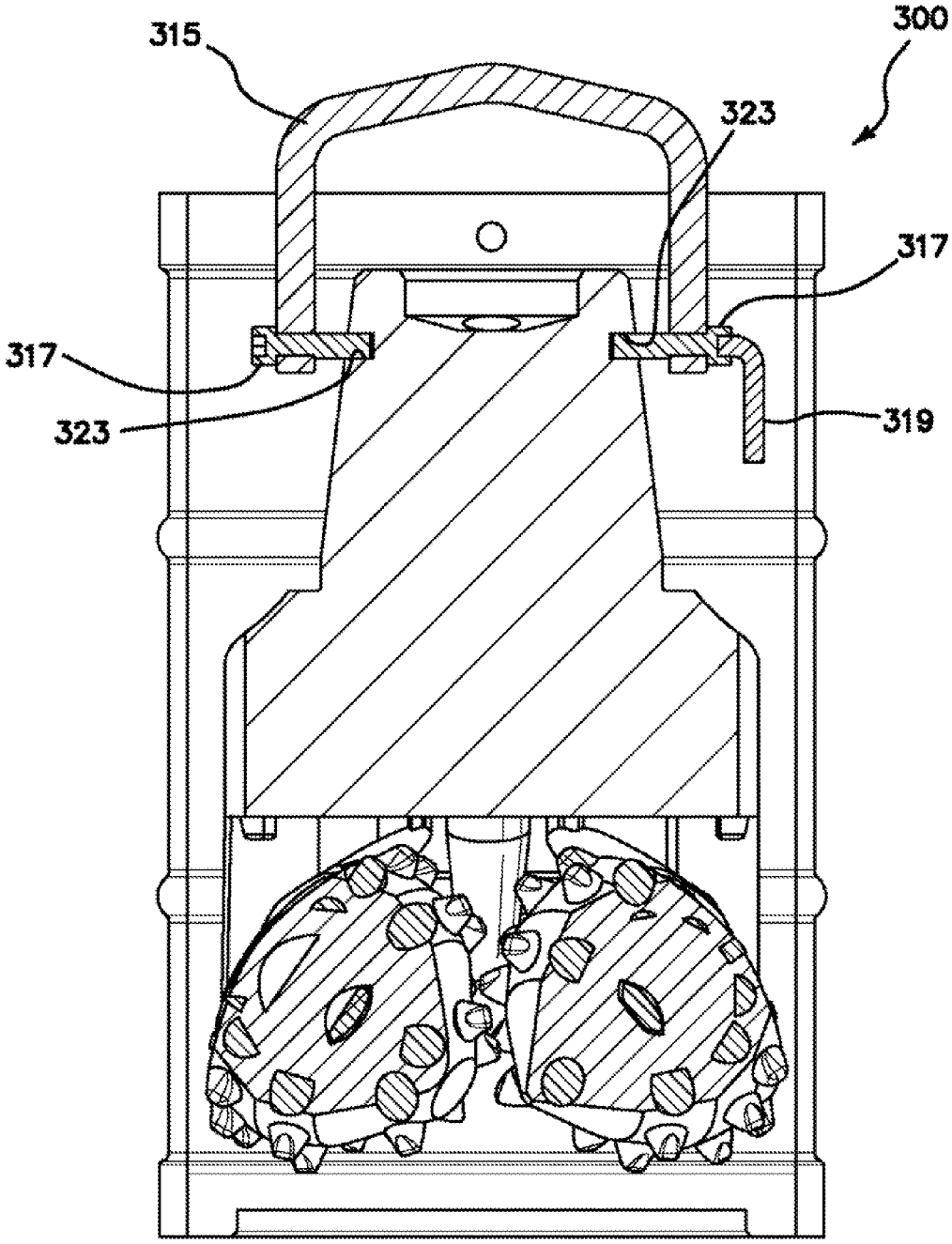
FIG. 22 is a cross sectional view of the container shown in FIG. 15 with the drill bit placed inside and the lid of the container removed.
Figure 23:
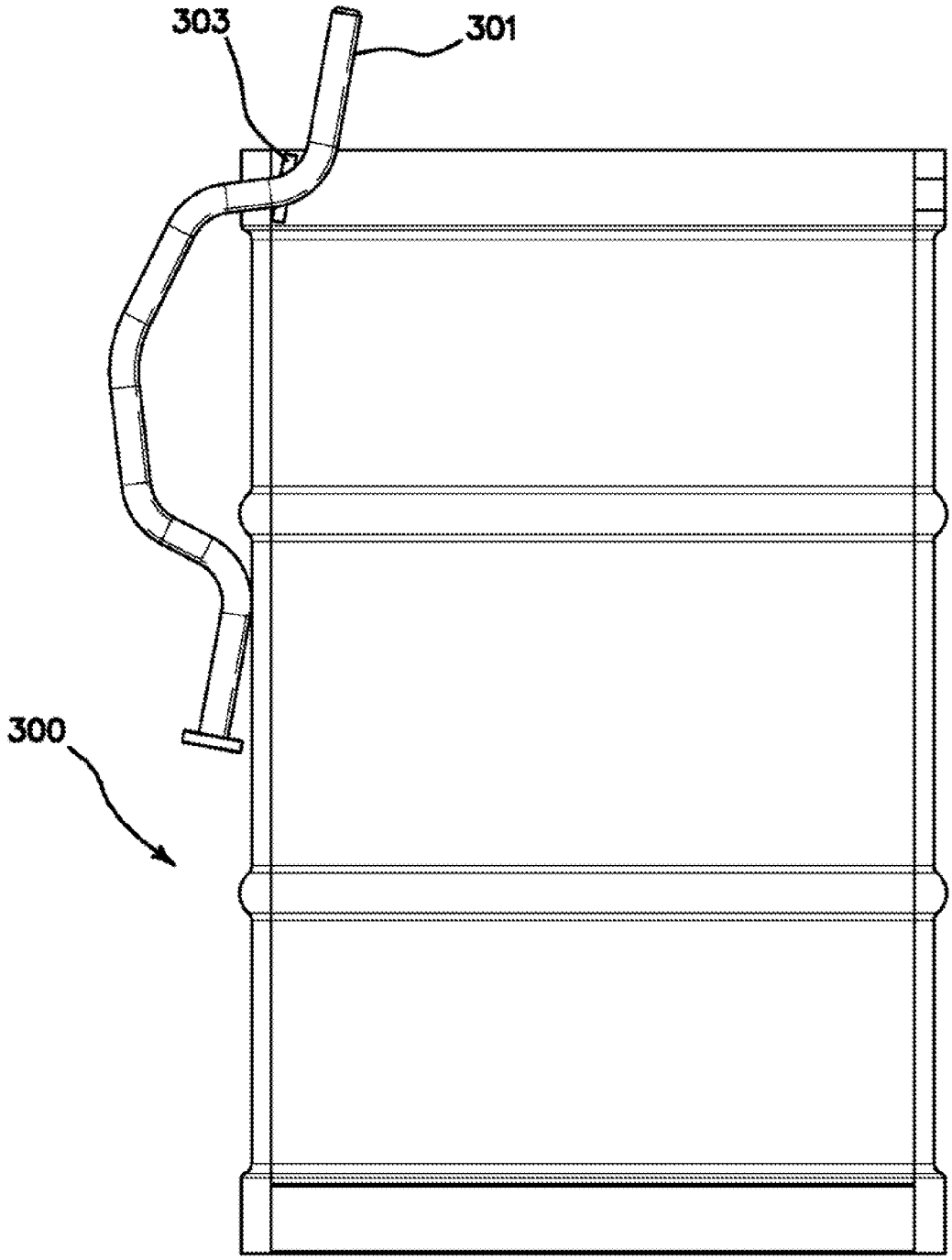
FIG. 23 is a perspective side view of the container with the lid removed.

After the entire drill bit 200 is assembled, it may be placed in an cylindrical or oil drum shaped container 300 as shown in FIG. 15 for protection during storage and transportation. Container 300 is shown in FIGS. 15, 20-23, with a rotatable handle 301 coupled to the body or barrel 307 of container 300, which handle 301 is retained thereto by a press-fit or fixed pin 303 as best seen in FIG. 20 in the configuration where lid 305 is closed and in FIG. 23 in the configuration where lid 305 has been removed. Alternatively, the handle 301 can be incorporated into, or secured to, the lid 305 and the lid 305 attached to the drum or container 300 by means of removable pins, these pins can be secured to the drum to eliminate the loss of the pins, in one example quarter turn spring pins are secured to the drum 300. In the closed configuration of FIGS. 15, 20 and 21, handle 301 is retained on barrel 307 by an integral flange 309 at one end and by a removable cotter pin 311 at the opposing end of handle 301. Handle 301 also retains lid 305 on the top of barrel 307 in this closed configuration. Cotter pin 311 is removed from handle 301 and handle 301 is translated across the top of barrel 307 until stopped by pin 303 as seen in FIG. 23. A groove 313 is defined completely across the diameter of the top of lid 305 to permit this translation of handle 301 across lid 305. Lid 305 may now be removed and handle 315 rotatably fitted to a pair of diametrically opposing bolts 317 inserted into blind holes 323 defined in the threaded portion 212 of the bit 200.

Bit lifting handle 315 is used to remove the bit 200 from its container 300 and carry to the bit breaker 321 shown in FIGS. 24-27. Handle 315 may also be used to remove the drill bit 200 from the bit breaker 321 and to return the used bit 200 back into its container 300. The handle 315 is made with threaded through holes on both ends, bolts or cap screws or threaded fasteners 317 pass through or screw through the threaded ends of the handle 315 and engage the preformed bores 323 in the pin end 212 of the drill bit 200. Optimally one threaded fastener 317 is fixed to the handle 315 while the other is movable. The threaded fasteners 317 and bit mating bores 323 have adequate clearances to allow the handle 315 to rotate freely about the axis of the preformed bores 323 after installation.

To install handle 315, the fixed threaded fastener 317 is inserted into one of the two preformed bores 323 in the pin end 212 of the drill bit 200 and the movable threaded fastener 317 is rotated, screwed through the handle 315, so the end of the threaded fastener 317 engages the unthreaded preformed bore 323 in the pin 212 until the head of the threaded fastener 317 bottoms out on the handle 315 at a predetermined location. The threads on the movable threaded fastener 317 may be upset or have another feature incorporated into it which allows it to rotate freely but won't allow it to be removed from the handle 315. A tool handle 319 may be fixed to the movable threaded fastener, for example, an Allen wrench welded to a cap screw of fastener 317.

A seal can be incorporated into the lid 305 to additionally protect the bit from the elements while in transit, this allows for one or more drain holes that communicate through the lid 305 and drum 300 to drain rain water that may accumulate in the lid 305.

Figure 24:
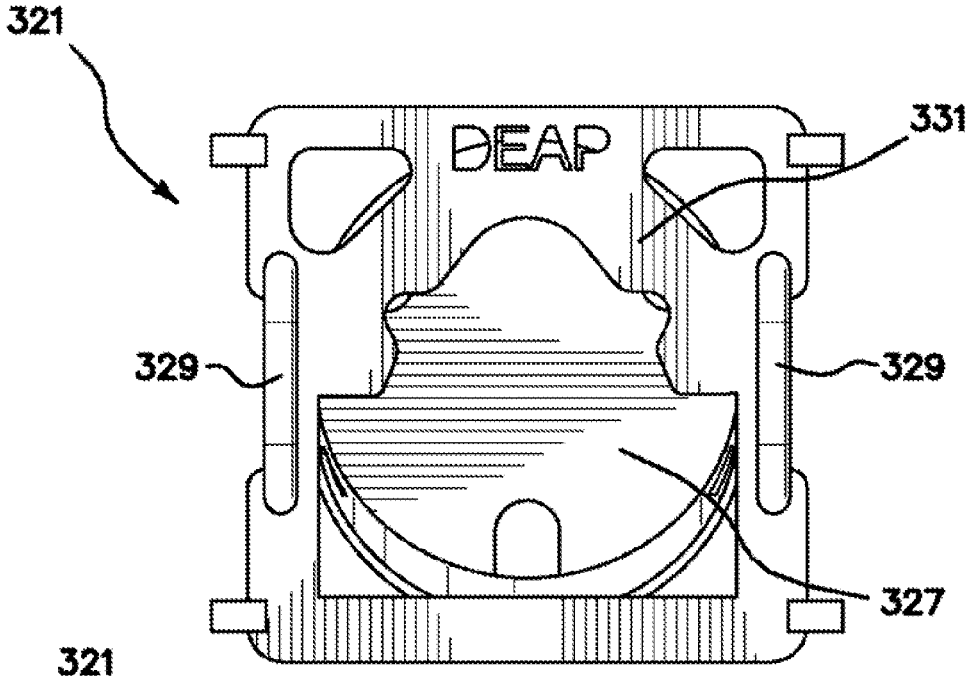
FIG. 24 is a top plan elevational view of the bit breaker with the top plates removed.
Figure 25:
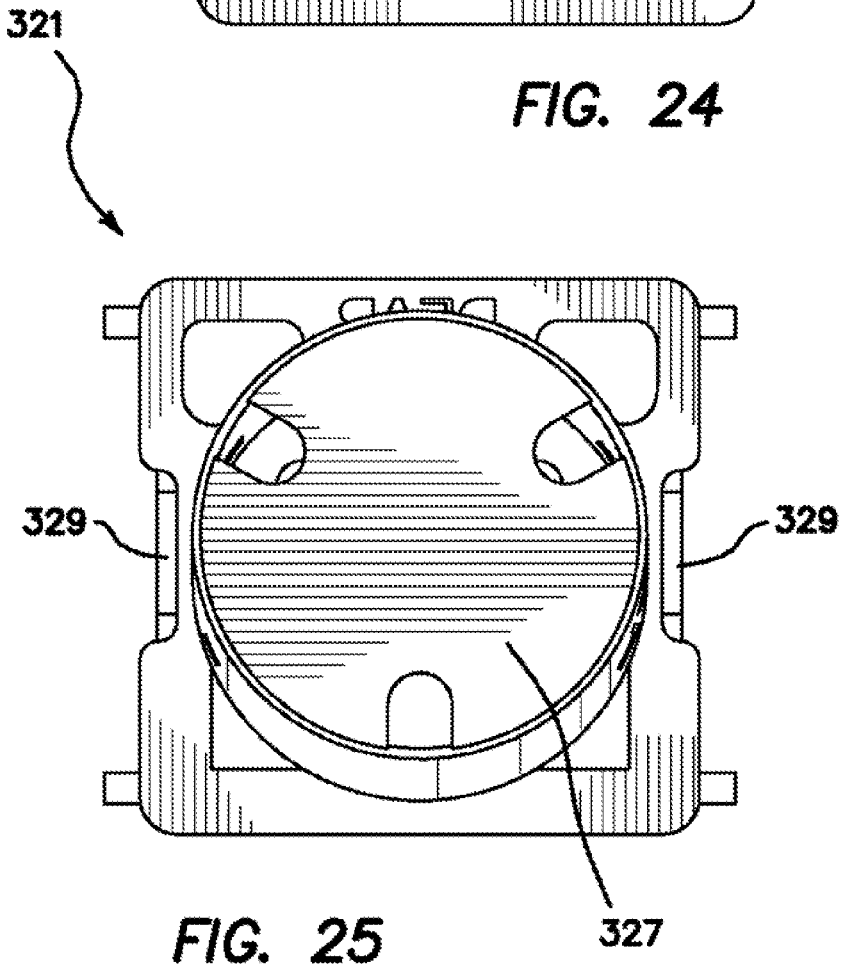
FIG. 25 is a bottom plan elevational view of the bit breaker shown in FIG. 24.
Figure 26:
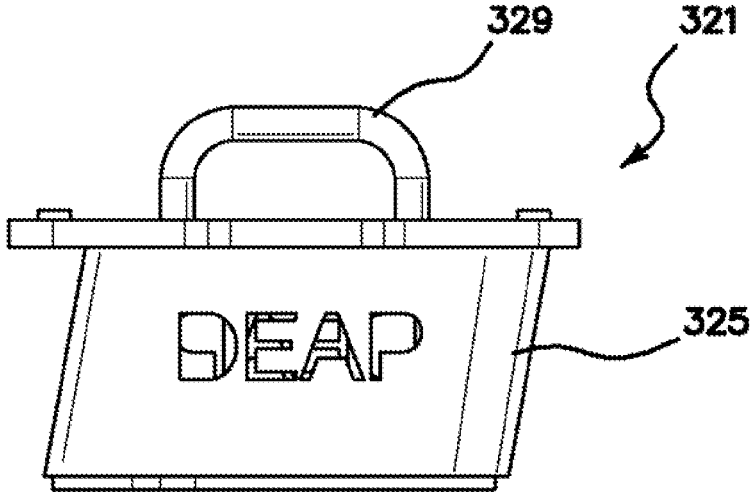
FIG. 26 is a plan view of the side walls of the bit breaker shown in FIG. 24.
Figure 27:
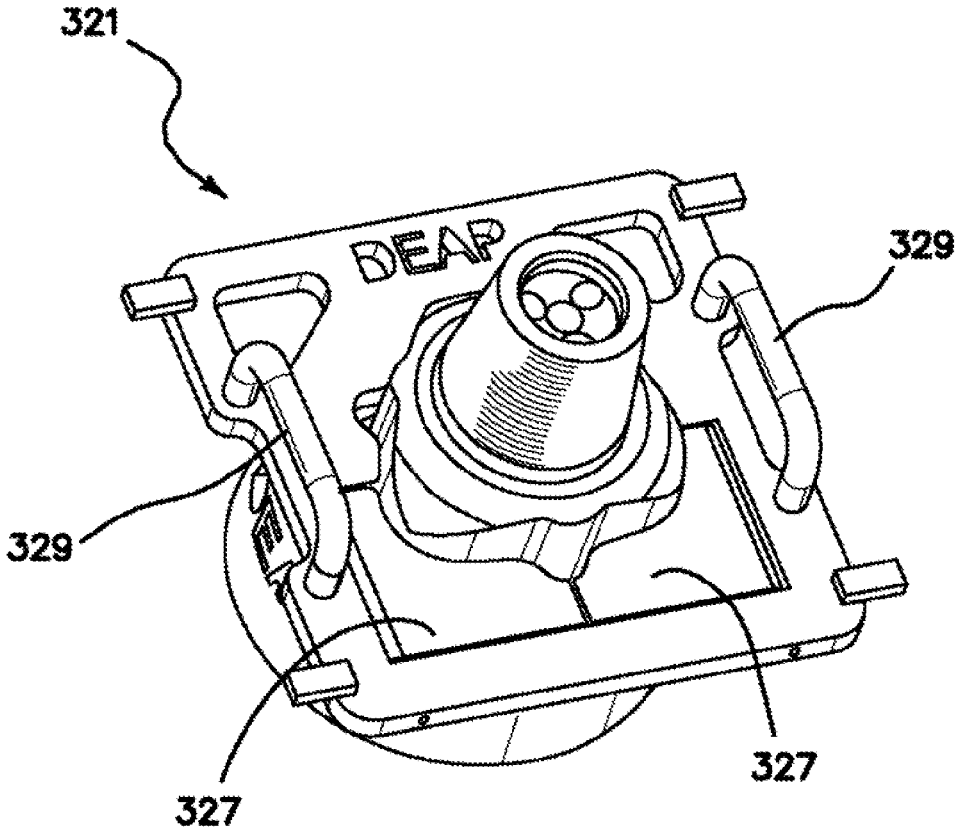
FIG. 27 is a perspective view of the bit breaker shown in FIG. 24 when equipped with hinged top plates and integral handles.

FIG. 24 is a top plan elevational view of bit breaker 321 with top plates 327 shown in FIG. 27 removed to clarity to show fixed floor 329 in greater clarity and also to show the keyed outline of fixed top plate 331, which fits or is keyed to the outside contour of the body of bit 200. FIG. 25 is a bottom plan elevational view of bit breaker 321 showing fixed floor 329 on which bit 200 will be placed and supported when handle 315 is removed, top plates 327 closed and bit 200 registered into position. Bit breaker 321 in FIGS. 24-27 is designed so that its supporting and guiding surfaces contact the body of the drill bit 200 not the cones 220*a*-220*c* thereby reducing the opportunity for bearing damage or twisting of the bits components. The side walls 325 of the bit breaker 321 as shown in FIG. 26 are canted for automatic bit registration, position, and alignment. The bit breaker 321 is equipped with hinged top plates 327 and integral handles 329 as shown in FIG. 27 to assist in this registration and alignment. The bit breaker 321 is placed into the drill rig turn table (not shown). The top of the bit breaker 321 or its hinged top plates 327 are opened to allow the bit 200 to easily pass through them. The bit 200 is lowered into the bit breaker 321, and as it is lowered it comes into contact with the canted wall 325 of the bit breaker 321 and floor 329, which automatically guides the bit 200 to the proper orientation and registration. The hinged top plates 327 are closed and surround or effectively clasp the bit's body perimeter, thereby holding it in place against the torque of the drill string and drill rig turn table to allow tightening or loosening of the drill bit 200 onto or off of the drill string.

Figure 16:
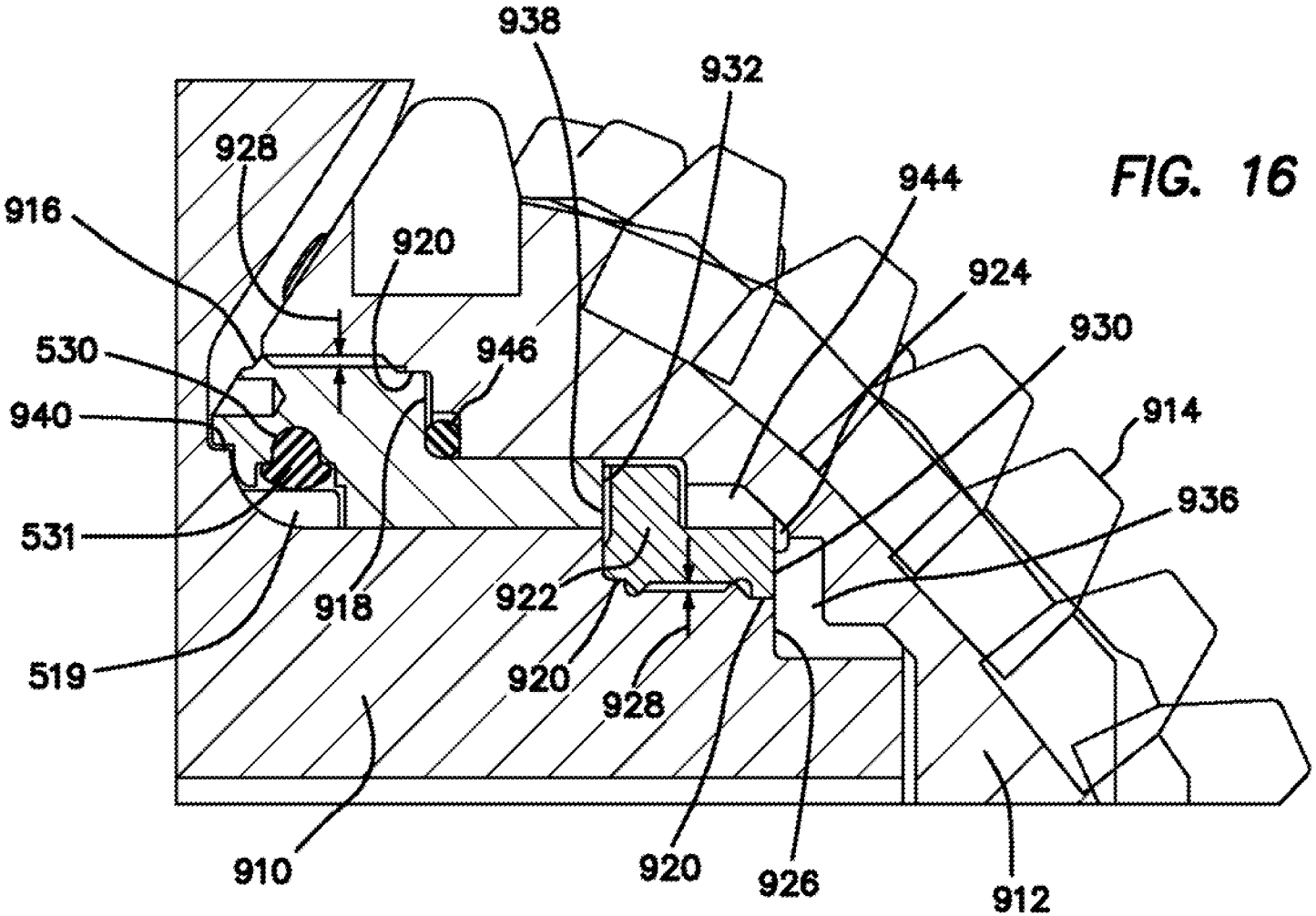
FIG. 16 is a diagrammatic side cross-sectional view of a cone and journal assembly in a leg of another embodiment of the invention.

An alternative embodiment of the journal and cone configuration to that described above is shown in the diagrammatic side sectional view of FIG. 16. A retention bushing 916 in combination with an O-ring seal 531, O-ring gland 530, and rotating symmetrical shirttail guard 940 is provided at the base of journal 910 as described above and the base of journal 910 is formed in the same manner as previously disclosed. Cone 912 which carries cutting structures 914 is affixed at its proximal portion by securing it to a retention bushing 916 by means of buttress threads, welding, or other means onto the bushing in which O-ring gland 530 is defined. Retention bushing 916 is slip fit into a mating interior cavity defined in cone 912. A shoulder portion 918 of retention bushing 916 is provided with rounded corners and a radial locating feature 920 as is the mating cavity in cone 912 so that retention bushing 916 and cone 912 mate together tightly with no possibility of any micro-movement between them.

Retention bushing 916 which is free to rotate on journal 910 is mechanically retained thereon by thrust nut 922 which is fixed to the distal end of journal 910 by means of buttress threads, welding, or other means. When welding the interface between the cone and the retention bushing, the cone/retention bushing interface diameter is increased to displace the weld interface away from the seal protecting the seal from the heat created by the welding process. Thrust nut 922 also has its outer surface dimensioned and configured to act as a further bearing surface for cone 912 or may be provided with sufficient radial clearances such that no radial load is applied to thrust nut 922 by cone 912. A relief area 924 is defined in a mating cavity in the interior of cone 912 adjacent to thrust nut 922 so that there is no mechanical interference at the corner of thrust nut 922 which would prevent the tight fitting of cone 912 onto retention bushing 916 and thrust nut 922. The end surface 926 of journal 910, including the possibility of a portion of the end surface 930 of thrust nut 922 together with the inner end surface 932 of 922 bearing against an opposing surface of retention bushing 916, is provided as a thrust bearing surface for cone 912 and its bushings. The embodiment of FIG. 16 is illustrated to include a radial bearing bushing 944 fixed to cone 912 and rotating on thrust nut 922 to carry radial loads as an extension of the journal bearing. Additionally, cone nose bearing bushing 936 is fixed to the distal interior surface of cone 912 and contacts thrust nut 922 and journal 910 to act both as an out-thrust bearing surface and a radial bearing surface for a spindle.

The assembly of journal 910 and cone 912 of FIG. 16 thus proceeds as follows. Seal riser bushing 519 is assembled onto the base of journal 910 and then retention bushing 916 including a lubricated O-ring 531 in O-ring gland 530 is slid onto the proximal portion of journal 910 and over seal riser bushing 519. Thrust nut 922 is then fixed on to the distal end of journal 910 thus retaining retention bushing 916 onto journal 910. Cone bushings 936 & 944 are fixed into the nose of Cone 912, Cone 912 is then slid over the assembled journal 910, retention bushing 916 and thrust nut 922 and fixed to retention bushing 916 by means of buttress threads, beam welded with a 360° weld, or by other means Thus, it may be appreciated that the longitudinal position of the cone 912 and retention bushing 916 in the direction of the axis of the journal 910 are fixed with respect to the journal 910 and thrust nut 922 by surfaces 932 and 926 so that no longitudinal micro-movement is possible, and the only free movement which is possible is the intended rotation of cone 912 and retention bushing 916 about the axis of journal 910.

In summary, then the embodiment of FIG. 16 is characterized as a thrust nut embodiment in which, first, a thrust nut is installed at the journal end and functions as a: (a) Retention member for retaining the retention bushing, the retention bushing subsequently retains the cone onto the journal after the cone is fixed to the retention bushing; (b) Thrust face, in-thrust for the retention bushing and out-thrust shared with the distal end of the journal; (c) Radial bearing, where the cone bearing I.D. runs on the thrust nut O.D. and has grease grooves on it's O.D. for lubrication. Second, thrust nut has a radial locating feature on its I.D. that matches, and works with a radial locating feature on the mating journal. Third, the thrust nut has an axial locating face, on its proximal end that matches, and works with an axial locating face on the distal end of the mating journal. Fourth, the thrust nut is fixed in place by means of: (a) Buttress threads; (b) Pins, bolts, thermal fitting, or other mechanical means; (c) Welding the thrust nut to the leg or (d) Any of the above in any combination. And fifth, the cone nose bushing and the radial bushing are fixed into the cone by means of dowels, welding, etc.

Continuing with the summary of the embodiment of FIG. 16 its assembly is realized by: (1) Installing the seal riser bushing on journal and securing it; (2) Installing the seal into the retention bushing gland; (3) Installing the retention bushing on journal; (4) Threading the thrust nut on journal end to retain the retention bushing, using a pin in the thread interface to assure the nut will not loosen: (5) Installing the static seal into the cone I.D. to seal the cone I.D.-to-retention-bushing O.D. interface; (6) Fixing cone nose bushings into the cone (7) Installing cone over the thrust nut and retention bushing and securing it to the leg with the retention bushing by means of buttress threads, welding, etc.; (8) Full loop greasing the leg and cone assembly; (9) Installing the sealing equalizer valve assembly; and (10) Plugging the burp hole.

Figure 17:
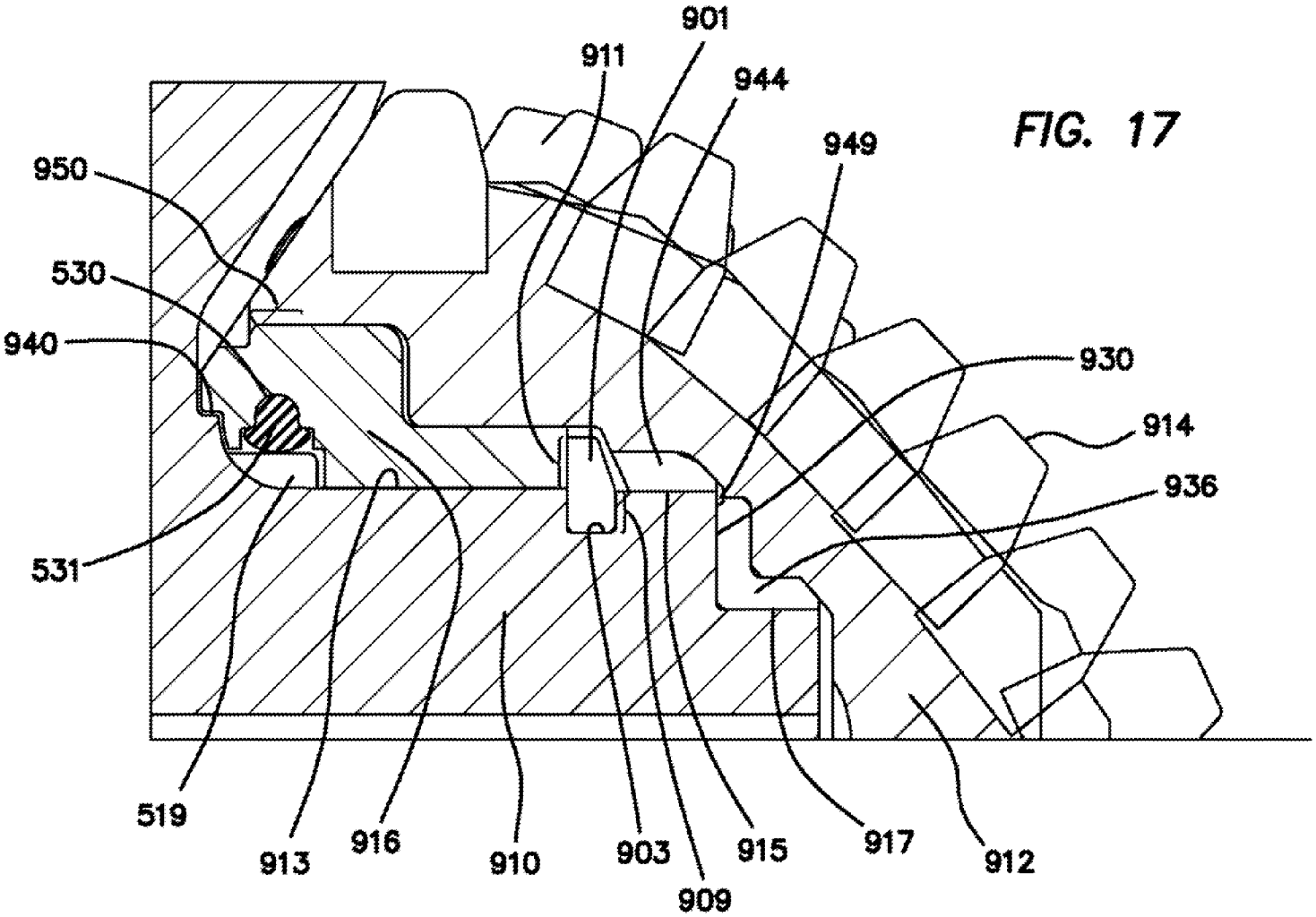
FIG. 17 is a diagrammatic side cross-sectional view of a cone and journal assembly in a leg of yet another embodiment of the invention.

Another embodiment is shown in the half side cross-sectional diagram of FIG. 17 which is characterized as a split ring configuration. Split rings (two half rings) 901 are installed into a groove 903 defined in the journal 910 that protrudes above the journal surface to engage and retain the retention bushing 916. The split rings 901 may have anti-rotation or locating features or shapes on their I. D. that match and engage with mating shapes defined in the mating journal groove 903. The split ring 901 is fixed into the leg groove 903 by: (a.) welding the split ring 901 to itself; (b.) pins, bolts, or other mechanical means; (c.) welding the split ring 901 to the leg 916; (d.) thermal fitting and/or press fitting; or (e.) a combination of any of the above. The embodiment of FIG. 17 can be used with cone nose bushings and radial bushings allowing the use of non-bearing materials for the cone assembly. The embodiment of FIG. 17 is illustrated to include the cone nose bushing 936 and radial bearing bushing 944 as in the case of FIG. 16 described above with the modification that the embodiment of FIG. 17 does not include a thrust nut.

The method of assembly of the embodiment of FIG. 17 includes the steps of installing the seal riser bushing 519 on journal 910 and fixing it in position; installing the seal 531 into the retention bushing gland 530; installing the retention bushing 916 over the journal 910 and seal riser bushing 519; installing the pre-oriented split ring 901 into the leg groove 903; securing the split rings 901 into the leg groove 903 for retaining the retention bushing 916; if the retention bushing is buttress threaded a conventional static seal 946 is installed into the cone I.D. to seal the cone I.D. to retention bushing O.D interface; installing the cone 912 onto the journal 910 and retention bushing 916 and securing the cone 912 to the leg by welding the retention bushing 916 circumferentially in region 950 or alternatively by threading the cone 912 and bushing 916 together using buttress threads; full loop greasing the leg and cone assembly; installing a sealing equalizer valve assembly; and plugging the burp hole.

It should also be noted that the embodiment of FIG. 17 includes a rotating seal guard 940 for the retention bushing 916 which serves as an axial collar to protect the shirttail defined at the base of the journal 910. The weld used to secure the split ring 901 into the leg groove 903 is perpendicular to the journal axis, on the distal surface of both the ring 901 and groove 903 in region 909, and may optionally penetrate deep enough to engage the bottom surfaces of the split ring 901 and journal groove 903. A portion of the proximal surface of the split ring 901 in region 911 serves as a thrust surface working with the distal thrust surface of the retention bushing 916. Front and rear main radial bearing surfaces 915 and 913 respectively and a spindle radial bearing surface 917 are provided. The retention bushing 916, cone nose bushing 936, and radial bushing 944 design of the embodiment of FIG. 17 allows for different combinations of materials to be used. Traditional drill bit cone materials need to have bearing qualities but this is not required with a design in which retention and cone nose bushings are employed.

Figure 18:
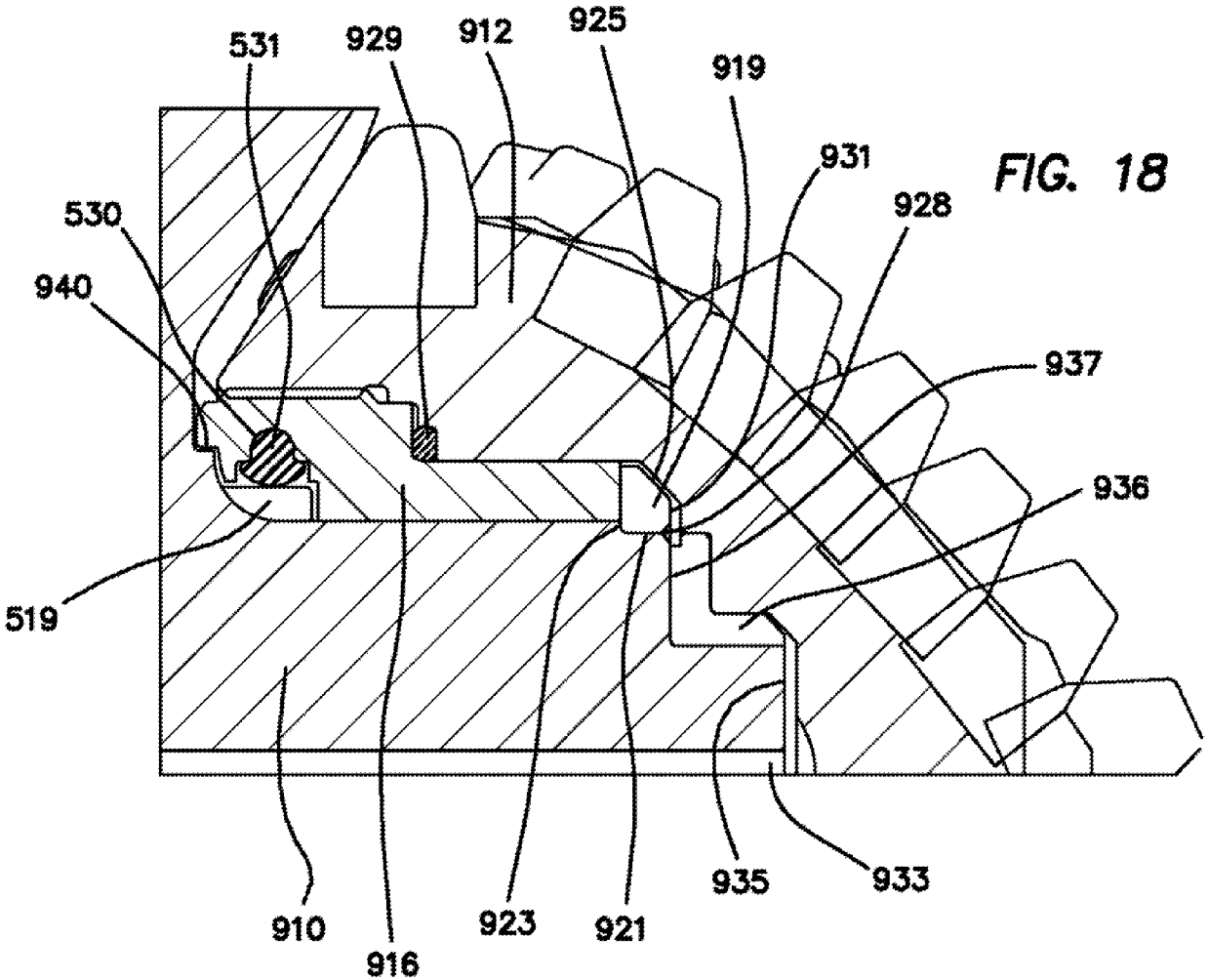
FIG. 18 is a diagrammatic side cross-sectional view of a cone and journal assembly in a leg of still another embodiment of the invention.

FIG. 18 depicts a half side cross-sectional view of another embodiment, which is characterized as a retention ring configuration. In this embodiment a retention ring 919 is installed onto a land or face 921 on the journal 910 at the journal's distal end and functions as a retainer for the retention bushing 916 and subsequently the cone assembly 912. The retention ring 919 is located by features on the distal portion of the journal 910, namely a stepped land or diameter 921 for locating the ring 919 and a face 923 to locate the ring 919 axially, and for creating a positive location. The stepped land 921 allows for welding of the retention ring 919 to the journal 910 without weld materials intruding through or past ring 919 into the bearing area behind it. The retention ring 919 has an axial locating face that matches and engages with a surface on the mating journal face 921. The retention ring 919 is fixed in place by means of welding along face 928 including energy beam welding. The weld is parallel to the journal axis. The retention ring 919 has a tapered distal end 925 to allow for increased cone cross section in the proximity of ring 919. The stepped journal diameter allows for the retention ring to journal interface to be completely welded without contaminating the radial bearing surfaces of bushing 916, or its thrust bearing surfaces. The design may also allow the weld to fuse two faces, the radial and the axial locating faces. The design does not leave the weld interface open to shrinkage that might otherwise be an area of crack propagation. The cone nose bushing 936 is fixed into the cone 912 by means of dowels, welding, etc.

When greasing the cone assembly grease enters through axial bore 933, flows through grooves and/or flats defined in the side of spindle 935 and matching grooves on the thrust face 937 to fill void 931 and flow over retention ring 919. The grease then flows through radial reliefs defined in the end surface of retention bushing 916, or the mating surface of retention ring 919, to access the bearing surface on journal 910. The grease is then forced to a relief defined on the bearing surface and through a bore communicated to a burp hole to exit from the back of the leg. This is called a full loop grease filling procedure whereby the air within the assembled drill bit is completely force out of the bit and replace by grease under positive pressure. Although this full loop grease filling procedure is described in the illustrated embodiment in connection with the embodiment of FIG. 17, it is to be understood that the procedure and its related structures is applicable to all embodiments in the specification.

Assembly of the embodiment of FIG. 18 may be practiced by the steps of installing seal riser bushing 519 on journal 910 and securing it thereto; installing a seal 531 into the retention bushing gland 530; installing a retention bushing 916 on journal 910; installing the retention ring 919 on the journal end to retain the retention bushing 916 and securing it to journal 910 by means of welding; installing a static seal 929 into the cone I.D. to seal the cone I.D. to retention bushing O.D interface; installing cone nose bushing 936 into cone 912 and fixing it thereto; installing cone 912 over the retention ring 919 and retention bushing 916 and securing cone 912 to the leg or journal 910 with the retention bushing 916, preferably engaging cone 912 and bushing 916 using buttress threads and/or by welding; full loop greasing the leg and cone assembly; install a sealing equalizer valve assembly; and plug the burp hole.

The embodiment of FIG. 18 also includes the additional features of a rotating seal guard 940 for the retention bushing 916. The illustrated retention bushing and cone nose bushing design allows for different combinations of materials to be used. Traditional drill bit cone materials need to have bearing qualities but this is not required with retention and cone nose bushings of FIG. 18.

In the foregoing embodiments the preferred method of fabrication is to start with fully heat treated raw materials, raw stock, billets, bar stock or the like. The raw materials are then machined in one or more steps or procedures to the final dimensions without any additional heat treating of the materials, or any intermediate form of the body, cones or legs or other drill bit elements being fabricated from the fully heat treated raw materials. For example, the bar stock for the cones and legs could be provided in fully heat treated steel and then machined to final dimensions without any secondary or additional heat treating operations. The body could be supplied as a fully heat treated forging and then machined in one operation to final dimensions. This approach reduces the time and money expected to fabricate the articles, decreases the cumulative tolerances increasing accuracy in dimensioning, reduces need for inventory, and increases throughput.

In summary, the invention provides many improvements in a rotating cone drill bit. The improvements include, for example, a rotating shirttail guard on the cone or on the retention bushing for covering a gap between the cone or retention bushing and an outer shirttail portion of the leg protecting the seal and sealing area of the cone-leg assembly from debris. A plurality of extended one piece mud nozzles which may be thermally fit into the bit body providing substantially obstruction-free mud paths. The drill bit of the invention has reduced sized cones relative to the bit size.

The improvements may further include an electron beam welded retention segment in each of the cone-journal assemblies. The welding is performed at a reduced angle of the electron beam relative to an axis of the journal, wherein the angle is between 3°-15°, preferably about 9°.

For insert-type cutting structures, the improvements include increased insert retention grip force resulting from thermal fitting of the inserts into the cones, increased carbide volume per cone resulting from increased insert number density and diameters and groove-less cones to improve strength of the cones and protects inserts from cone wash out.

The improvements may further include a seal riser bushing thermally fit and/or mechanically fixed to the journal where the journal projects from the corresponding leg.

The improved rotating cone drill bit may include means for fixing relative angular orientations of the legs and means for fixing relative angular orientations of the leg/cone assemblies prior to assembly, thus achieving a "true geometry."

The improvements may further include a sealing floating equalizer valve for equalizing a pressure between the down hole environment and cavities adjacent to the bearing surfaces.

The improved legs have back tapers for a clearance between the legs and the wellbore wall surface.

An improvement in a rotating cone drill bit storage and transportation method is also provided, including providing a cylindrical drill bit container with a lifting handle that looks like a miniature oil drum.

The improvements may further include having a full loop lubrication filling procedure for each of the plurality of bearing surfaces entering through the lubricant access bore and exiting an electron beam bore and a lubricant/air burp aperture or other burp hole.

The improvements may further include an improved lubricant with silver talc added as an additive.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A cutter assembly for a rotating cone drill bit having a plurality of cutter assemblies, each cutter assembly comprising:

a journal having an axis; and a cone arranged and configured to rotate about the axis of the journal, the cone characterized by having a shell thickness and by having a plurality of cutting structures on the cone;

wherein the cutting structures comprise a plurality of inserts, where the shell thickness is sufficient to permit a uniform depth of grip as adjusted by a fisheye effect and a uniform grip diameter between the cone and each of the plurality of inserts when thermally fit into the cone regardless of the location of the insert on the cone, so that the thermal fitting of inserts provides a greater cone shell cross section for the same insert grip length due to the reduction of larger lead chamfer on the inserts as compared to traditional press fit methods, effectively allowing reduction of the cone cross section and allowing a reduced overall external envelope size of the cone to create a larger debris clearing volume between the plurality of cutter assemblies.

2. A rotating cone drill bit comprising:

a body;

a plurality of legs coupled to the body;

a corresponding plurality of rotating cones carried by the legs, where the cones are composed of a nonbearing material;

where each leg has a corresponding journal onto which a corresponding cone is rotatably mounted, the journal having a cylindrical shape of a first diameter and a terminal cylindrical spindle of a second diameter less than the first diameter;

each cone having a cone nose bushing composed of bearing material, fixed to the cone and providing a bearing surface for rotatably coupling the cone with the spindle; and each cone having a retention bushing composed of bearing material, fixed to the cone and providing a bearing surface for rotatably coupling the cone with the bearing surface of the journal.

3. A rotating cone drill bit comprising:

a body;

a plurality of legs coupled to the body; a corresponding plurality of rotating cones carried by the corresponding plurality of legs, where the cones are composed a nonbearing material;

where each leg has a corresponding journal onto which a corresponding cone is rotatably mounted, where the journal joins with the leg with a surface defining a journal-to-leg transition having a smooth radius of curvature of increasing diameter moving from the journal to the leg providing increased journal-to-leg strength to smoothly and gradually increase the diameter of the leg in the journal-to-leg transition;

a retention bushing fixed to each cone rotating on a corresponding journal and having a bearing surface between the retention bushing and journal, the retention bushing having a relieved surface adjacent to the journal-to-leg transition to allow the cone to be proximately positioned to the leg at minimal separation; and means for retaining the retention bushing on the journal without denigrating the bearing surface between the retention hushing and journal.

4. An improvement in a rotating cone drill bit for drilling a well bore having a wellbore bottom while utilizing drilling fluid, comprising:

a bit body with an axis;

a plurality of rotating cones with inserts mounted on the bit body; and a plurality of mud nozzles extending from the bit body and thermally fit into the bit body, each mud nozzle having an exit orifice within a distance of the wellbore bottom near the lower extremity of the cutters and the bottom of the borehole where each of the mud nozzles is arranged and configured to extend past the cones and inserts to deliver the mud flow unimpeded to the well bottom bore without interference from the cones and inserts.

* * * * *